US006585054B1

(12) United States Patent
Thomas et al.

(10) Patent No.: US 6,585,054 B1
(45) Date of Patent: Jul. 1, 2003

(54) FAST RESPONSE SPRINKLER HEAD AND FIRE EXTINGUISHING SYSTEM

(75) Inventors: Peter W. Thomas, Hastings, MI (US); Thomas G. Deegan, Grand Rapids, MI (US); Scott T. Franson, Hastings, MI (US); Michael J. Bosma, Hastings, MI (US); Delwin G. Dornbos, Wyoming, MI (US)

(73) Assignee: The Viking Corporation, Hastings, MI (US)

( * ) Notice: Subject to any disclaimer, the term of this patent is extended or adjusted under 35 U.S.C. 154(b) by 0 days.

(21) Appl. No.: 09/579,552

(22) Filed: May 26, 2000

Related U.S. Application Data

(60) Provisional application No. 60/136,498, filed on May 28, 1999.

(51) Int. Cl.[7] ..... A62C 37/08

(52) U.S. Cl. ..... 169/37; 169/38; 169/40; 169/41; 169/42; 169/56; 169/57; 169/58; 169/59; 169/60

(58) Field of Search ..... 169/37, 38, 40, 169/41, 42, 56, 57, 58, 59, 60

(56) References Cited

U.S. PATENT DOCUMENTS

| | | | | |
|---|---|---|---|---|
| 447,004 | A | * | 2/1891 | Nagle |
| 1,093,063 | A | * | 4/1914 | Meloon |
| 3,866,686 | A | * | 2/1975 | Goodsell, Jr. et al. |
| 3,893,513 | A | * | 7/1975 | Marsh |
| 5,609,211 | A | * | 3/1997 | Meyer et al. |
| 5,829,684 | A | * | 11/1998 | Fishcer |
| 5,862,994 | A | * | 1/1999 | Pounder et al. |
| 5,915,479 | A | * | 6/1999 | Ponte |

* cited by examiner

*Primary Examiner*—Robin O. Evans

(74) *Attorney, Agent, or Firm*—Van Dyke, Gardner, Linn & Burkhart, LLP

(57) ABSTRACT

A fast response, upright sprinkler head includes a body having a central orifice through which fire extinguishing fluid is expelled through an outlet end. A yoke, attached to the exterior surface of the sprinkler body, extends beyond the outlet end of the sprinkler body and is connected at its apex to a deflector. A fusible trigger assembly is coupled to the yoke and the outlet end of the sprinkler head. The deflector is formed with a planar member having a skirt depending therefrom and an annular ledge extending horizontally from the skirt. The skirt depends from the planar member in an outward direction at a pre-selected angle from the vertical, and is formed with a plurality of through-holes. The fast response upright sprinkler head is configured to have a K value of at least 13.5, while the fusible trigger assembly has a fusing temperature between approximately 155° F. and 175° F. to thereby provide a fast response sprinkler head capable of expelling a sufficient density of water during the early stages of fire development. The angle of the skirt, as well as the through holes formed therein, alter the trajectory of the water to thereby provide a hemispheric pattern of large water droplets capable of penetrating the fire plume and reaching the fire source in order to suppress or extinguish the same. In another aspect of the invention, the fast response upright sprinkler head is used in a fire extinguishing system and method wherein the upright sprinkler head is placed in proximity to a horizontal obstruction depending from, or otherwise supported, a preselected distance from the ceiling of an enclosure. The upright sprinkler system of the present invention develops an effective spray distribution pattern about the obstruction to thereby suppress a fire positioned directly below, or approximately below, the obstruction.

64 Claims, 9 Drawing Sheets

| TEST PARAMETERS | |
|---|---|
| Commodity | FMRC Standard Plastic Commodity |
| Storage Arrangement | Double-Row Racks |
| Array Size (pallet loads) | 2 x 6 x 4 |
| Stack Height (ft-in.) | 19 - 6 |
| Number of Tiers | 4 |
| Clearance to Ceiling (ft-in) | 10 - 6 |
| Clearance to Sprinkler Deflector (ft-in) | 9 - 11 |
| Aisle Width (ft) | Do Not Apply |
| Ignition Centered Below (Number of Sprinklers) | 1 (The outside diameter of the sprinkler pipe over the ignition location was equal to that of a schedule - 40, 2.5 in. pipe.) |
| Sprinkler Orifice Size (in.) | 0.7 |
| Sprinkler Temperature Rating (°F) | 165 |
| Sprinkler RTI (ft-s)$^{1/2}$ | 50 |
| Sprinkler Spacing (ft x ft) | 10 x 10 |
| Sprinkler I.D. | Upright |
| Constant Water Pressure (Psig) | 50 |
| **TEST RESULTS** | |
| Number of Sprinklers Opened | 1 |
| Peak Gas temperature (°F) | 183 |
| Max. One Min. Ave. Gas Temp (°F) | 92 |
| Peak Ceiling Steel Temperature (°F) | 90 |
| Max. One Min. Ave. Steel Temp (°F) | 89 |
| Fire Jump | Does Not Apply (Fire jump across a 4-ft. wide aisle is deemed unlikely based on the heat flux measurement.) |
| Equivalent Number Pallet Loads Consumed | 1.5 |

FIG. 16

| Distance from Sprinkler to Side of Obstruction (A) | Maximum Allowable Distance of Deflector above Bottom of Obstruction (in.) (B) |
|---|---|
| | |
| Less than 1 ft | 0 |
| 1 ft to less than 1 ft 6 in. | 1 1/2 |
| 1 ft 6 in. to less than 2 ft | 3 |
| 2 ft to less than 2 ft 6 in. | 5 1/2 |
| 2 ft 6 in. to less than 3 ft | 8 |
| 3 ft to less than 3 ft 6 in. | 10 |
| 3 ft 6 in. to less than 4 ft | 12 |
| 4 ft to less than 4 ft 6 in. | 15 |
| 4 ft 6 in. to less than 5 ft | 18 |
| 5 ft to less than 5 ft 6 in | 22 |
| 5 ft 6 in. to less than 6 ft | 26 |
| 6 ft | 31 |

For SI units, 1 in. = 25.4 mm; 1 ft = 0.3048 m.

Note: For (A) and (B), refer to Figure 5-11.5.1.

FIG. 17

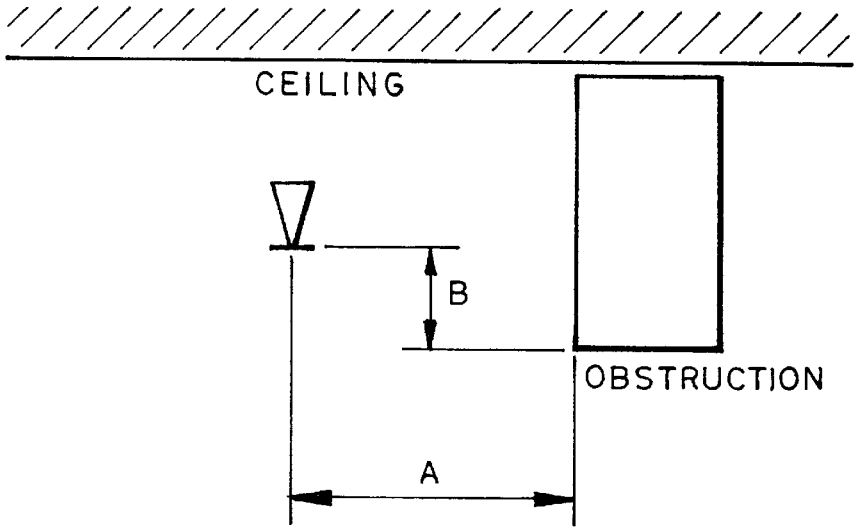

FIG. 18

FAST RESPONSE SPRINKLER HEAD AND FIRE EXTINGUISHING SYSTEM

CROSS-REFERENCE TO RELATED APPLICATION

This application claims priority in U.S. Provisional Patent Application Serial No. 60/136,498, filed May 28, 1999, the disclosure of which is hereby incorporated herein by reference.

BACKGROUND OF THE INVENTION

The present invention relates to sprinklers used in automatic fire extinguisher systems for buildings and the like, and in particular, relates to a fast response sprinkler head and fire sprinkler system for use in environments wherein one or more obstructions are positioned in proximity to the sprinkler head.

Automatic sprinklers have long been used in automatic fire extinguishing systems for buildings in order to disburse a fluid to control a fire. Typically, the fluid utilized in such systems is water, although systems have also been developed to disburse foam and other materials. Historically, sprinkler heads include a solid metal base connected to a pressurized supply of water, and some type of deflector used to alter the trajectory of the water flow. Alteration of the water flow by the deflector generates a defined spray distribution pattern over the protected area. The deflector is typically spaced from the outlet of the base by a frame, and a fusible trigger assembly secures a seal over the central orifice. When the temperature surrounding the sprinkler head is elevated to a pre-selected value indicative of a fire, the fusible trigger assembly releases the seal and water flow is initiated through the sprinkler head.

Fire extinguishing sprinkler heads come in three general structural types, namely, upright, pendent and sidewall. Of interest to the present application are the pendent type and, in particular, upright structural type. Pendent sprinklers depend below a fire extinguishing fluid supply pipe, such as a water pipe. In pendent sprinklers, when the fusible trigger assembly reaches a pre-selected temperature due to the presence of fire, the fusible trigger assembly releases the seal positioned over the outlet, enabling water to flow through the central orifice of the sprinkler head in a downward direction. As the water exits from the sprinkler head, it is typically disbursed by the deflector which alters the trajectory of the water so as to define a spray distribution pattern in an attempt to control the fire.

An upright sprinkler differs from a pendent sprinkler in that it projects upwardly from the fluid supply pipe. When an upright sprinkler is activated, the water flows upward through the sprinkler head and is expelled from the central orifice in an upward direction. Gravitational forces, in combination with the deflector spaced a pre-selected distance above the central orifice, results in the formation of a downwardly. moving spray distribution pattern in an attempt to control a fire. In addition to some common benefits and advantages, pendent and upright sprinklers each have some benefits relative to the other type. Upright sprinklers for example, have less of a tendency to collect contaminant build-up since the containments settle down into the branch pipe and thus potential blockage is reduced.

Historically, automatic sprinkler systems have been designed to achieve what is referred to as "fire control" about a protected area. In the fire control method of combating fires, the automatic sprinkler system is designed and installed such that a relatively large number of individual sprinklers will activate upon detection of a fire. That is, in response to a fire, not only will the sprinklers closest to the fire be actuated, but also sprinklers which protect the areas surrounding the fire, so as to define a controlled area. While it is anticipated that the sprinklers immediately above the fire may not be able to extinguish the fire, the goal of the fire control method is to actuate the sprinklers about the fire to pre-wet the combustible materials in the fire's general vicinity to prohibit the fire's growth. Thus, the fire control method seeks to confine the fire within a predetermined area until additional fire fighting methods are deployed, such as response by a fire department, in order to extinguish the fire.

Beginning in the 1970's, industries began more widely using relatively large warehouses for the storage of product. To effectively utilize space within these warehouses, product is normally stacked on pallets or racks in a vertical arrangement. These warehouses may reach approximately 30 feet in height and contain stacked pallets as high as approximately 25 feet. Traditional sprinklers, designed and installed so as to provide "fire control," have proven ineffective in combating fires ignited in these large warehouses. As the vertically stacked pallets may exceed over twenty feet in height, fires ignited within these pallets produce a plume of combustion gasses which rapidly travels upward and subsequently impacts the ceiling of the warehouse. The rapid generation of these combustion gases creates a zone of high temperature above the fire, and thus when the sprinkler head is activated, an unacceptable quantity of water expelled from the sprinkler is evaporated within this high temperature zone before it reaches the site of the fire. As a result, less water is actually delivered to the fire and hence prevents effective fire control.

After impacting the ceiling, these combustion gases span out in a horizontal direction along the surface of the ceiling. The rapid movement of the combustion gases along the ceiling results in the actuation of a large number of sprinkler heads located a remote distance from the perimeter of the fire. The mass actuation of sprinkler heads within the warehouse produces several unacceptable consequences. First, the near simultaneous actuation of a large number of sprinkler heads produces a significant decrease in the water pressure delivered to each individual sprinkler head. Consequently, less water is available for delivery to the fire and thereby provides an opportunity for the fire to spread. Furthermore, actuation of remotely located sprinkler heads results in water damage to the product protected by such sprinklers.

In response to the inadequacies of existing sprinkler heads and the "fire control" deployment method, the sprinkler industry began the design and installation of "Early Suppression Fast Response" (hereinafter referred to as "ESFR") sprinkler heads. As the name indicates, the theory behind ESFR is to deliver a sufficient quantity of water during the early stages of fire development in order to suppress and extinguish the fire and deny the opportunity for fire growth. In order to achieve the goal of early suppression, ESFR sprinklers must quickly generate a sufficient quantity of water capable of penetrating the fire plume and thus be delivered to the core of the fire, often referred to in the industry as the "fuel package." To deliver a sufficient quantity of water to the "fuel package", ESFR sprinklers are equipped with a thermally sensitive fusible trigger assembly capable of actuating the sprinkler head shortly after ignition of the fuel package. Normally, ESFR sprinklers utilize fusible trigger assemblies which have a fusing temperature between approximately 155° F. and 175° F.

To determine the ability of these ESFR sprinklers to suppress high challenge fires generated by industrial warehouses, the sprinkler industry, and in particular the Factory Mutual Research Corporation (hereinafter "FMRC"), developed the concepts of actual delivered density (hereinafter "ADD"), required delivered density (hereinafter "RDD"), and response time index (hereinafter "RTI") as quantifiable measures of sprinkler performance. The RDD is the amount of water that must be delivered to a fuel package composed of a particular type of combustible material in order to achieve suppression. The establishment of a RDD value for a particular fuel package is achieved by various tests most oftenly conducted by the FMRC. The ADD value depends on the construction of the particular sprinkler head and is defined as the amount of water which is actually deposited onto the top of a combustible fuel package. Generally speaking, the RDD value increases as a function of time once ignition of the fuel package is initiated. During the maturation of the fire, the RDD increases as a function of time because as the fire develops, more combustion gases are generated and thus more water must be generated due to the quantity of water evaporated by the fire plume. The ADD generally decreases as a function of time, until the fire reaches full maturation. The decrease in the ADD as a function of time is also due to the growth of the fire plume, which results in an increasing water evaporation rate, and thus reduces the quantity of water actually delivered to the fuel package. Under the ESFR theory, early suppression is achieved if the ADD is greater than the RDD.

The ADD value of a particular sprinkler is largely a function of the discharge coefficient or "K" value. The K value is defined by the following equation:

$$k=q/\sqrt{p}$$

q=flow in gallons per minute; and p=water pressure pounds per square inch. As a result of testing by the sprinkler industry, ESFR sprinklers must have a K value of at least 13.5, and preferably 14 or greater.

The RTI value is essentially a measure of the thermal sensitivity of the fusible trigger assembly which actuates the sprinkler head. Consequently, the lower the RTI value of a particular sprinkler, the faster the actuation time of the sprinkler head in response to a fire, which in turn decreases the ADD value necessary to extinguish the fire.

Since the advent of ESFR sprinklers in the 1970's, the sprinkler industry has attempted to design upright sprinklers having the ADD values necessary to adequately suppress a fire. Despite these attempts, heretofore, the industry has been unable to generate an upright sprinkler head capable of achieving ESFR standards, and has only produced pendent sprinklers having the requisite ADD criteria. The inability of the industry to generate an ESFR sprinkler having an upright design has presented problems in the industry, specifically, in the retrofitting of warehouses. Prior to the advent of ESFR sprinklers, many warehouses employed traditional upright sprinkler assemblies. Consequently, retrofitting warehouses designed to accommodate upright sprinklers with ESFR pendent sprinklers has required warehouse owners to tear out existing piping and replace the same with piping capable of supporting pendent ESFR sprinklers. This, in turn, has increased the cost and complexity of installing an ESFR sprinkler system.

In order to provide uniformity in the design and installation of sprinkler systems, as well as to maximize the probability that the installed sprinkler system will operate in an effective manner, the National Fire Protection Association (hereinafter referred to as the "NFPA") generates criteria or regulations for both the design and installation of fire sprinkler systems. The NFPA is comprised of a wide cross-section of companies and organizations having expertise and interest in fire protection safety. The first set of regulations issued by the NFPA occurred at the beginning of the 20th Century and has been continuously updated in light of advances and changes in technology. The NFPA regulations or guidelines are based on data gained by over one hundred years of experience in the evaluation of sprinkler systems. Compliance with NFPA guidelines, in particular NFPA 13, which governs the installation of sprinkler systems (discussed hereinafter in detail), is frequently required by federal and state enforcement agencies, and is accepted by the insurance industry as the definitive guideline concerning the installation and design of sprinkler systems. Consequently, as a commercial practicality, sprinkler designs and the installation of sprinkler systems must be able to perform successfully within the guidelines set by the NFPA, and in particular NFPA 13. Failure to conform or operate successfully within the NFPA guidelines ieffectively prohibits the commercial viability of a particular sprinkler design or its installation.

In addition to providing guidelines concerning the design and installation of sprinklers, the FMRC, in conjunction with the NFPA, have established "commodity" classifications which categorizes materials commonly found in warehouses or storage facilities. Each commodity classification segregates materials according to their degree of combustibility and the operating requirements necessary to extinguish them. For each of these commodities, a particular sprinkler head must meet certain water supply and discharge requirements in order to provide adequate protection. Currently, materials are classified in the following commodity classifications: class 1 through 4, carton unexpanded plastic, cartoned expanded plastic, uncartoned unexpanded plastic and uncartoned expanded plastic. Of these commodities, uncartoned unexpanded and expanded plastic commodities represent the two most challenging fire hazards, with uncartoned expanded plastic carton commodities representing the most challenging fire scenario.

Of particular importance to the present invention are those sections of NFPA 13 which govern the installation of ESFR sprinklers in areas having obstructions supported by and depending from, or otherwise supported below, the ceiling of a warehouse or enclosure. The 1996 Edition of NFPA 13 provides specific spatial requirements concerning the placement of ESFR sprinklers in proximity to obstructions that prevent the sprinkler from developing an effective spray distribution pattern. Specifically, §4-11.5.2 is directed to the issue of obstruction to sprinkler discharge in ESFR sprinklers, and defines a minimum horizontal or lateral distance that the sprinkler head must be placed from the obstruction. NFPA 13 (1996 ed.), §4-11.5.2 states as follows:

> Sprinklers shall be positioned such that they are located at a distance three times greater than the maximum dimension of an obstruction up to a maximum of 24 inches (609 mm) (e.g. structural members pipes, columns, and fixtures). Sprinklers shall be positioned in accordance with FIG. 4-11.5.2 where obstructions are present.

FIG. 4-11.5.2, referenced in §4-11.5.2 of NFPA 13 (1996 ed.) is reproduced herein as FIG. 1. In FIG. 1, "a" corresponds to the horizontal or lateral distance between the sprinkler head and the obstruction, whereas "c" defines the height and "d" the width of the obstruction positioned below the sprinkler head. An "obstruction" as used in §4-11.5.2 may be a bottom chord of a truss or joist, a pipe, duct, light fixture, or similar horizontally positioned fixture commonly encountered in a warehouse or storage facility.

The 1999 edition of NFPA 13 §5-11.5.1 details the requirements of ESFR sprinklers when obstructions are present at or near the ceiling and states as follows:

Sprinklers shall be arranged to comply with Table 5-11.5.1 and FIG. 5-11.5.1 for obstructions at the ceiling such as beams, ducts, lights, and top cords of trusses and bar joists.

Table 5-11.5.1 and FIG. 5-11.5.1 are reproduced herein as FIGS. 17 and 18, respectively. In addition, the 1999 version of NFPA 13, in §5-11.5.2, addresses the placement of ESFR sprinklers when isolated obstructions are present below the elevation of sprinklers and requires that:

Sprinklers shall be installed below isolated noncontinuous obstructions that restrict only one sprinkler and are located below the elevation of sprinklers, such as light fixtures and unit heaters.

Furthermore, §5-11.5.3 of NFPA 13 (1999 ed.) provides guidelines concerning continuous obstructions located below the ESFR sprinklers of a sprinkler system and provides:

Sprinklers shall be arranged to comply with Table 5-11.5.1 for horizontal obstructions entirely below the elevation of sprinklers that restrict sprinkler discharge pattern for two or more adjacent sprinklers, such as ducts, lights, pipes, and conveyors.

Finally, §5-11.5.3.2 of an NFPA 13 (1999 ed.) requires:

ESFR sprinklers shall positioned a minimum of one foot (0.3 m) horizontally from the nearest edge to any bottom cord of a bar joist or open truss.

Thus, it can be seen from the above cited sections of both the 1996 and 1999 edition of NFPA 13 that various guidelines and regulations govern the installation of ESFR sprinklers in applications where the area to be protected includes one or more types of obstructions. It is believed that the sections cited above from NFPA 13 (1999 ed.) define and clarify additional guidelines concerning the installation of ESFR sprinkler systems, and acts as a supplement to §4-11.5.2 of NFPA 13 (1996 ed.).

Conformance with the above cited sections of NFPA 13, has heretofore been a practical necessity governing the installation of all ESFR sprinkler assemblies due to the inability of sprinkler manufacturers to produce an ESFR sprinkler head having the requisite ADD value for a fuel package consisting of a particular type of combustible material, which is also capable of developing a spray distribution pattern in proximity to these obstructions. Conformance with NFPA 13 (1996 ed.) §4-11.5.2, and the above-referenced sections of NFPA 13 (1999 ed.) has added additional cost to the installation of sprinkler systems by requiring the placement of additional sprinklers in areas surrounding the obstruction. Furthermore, the various sections of NFPA 13 (1999 ed.) has increased the complexity of the installation procedure of ESFR sprinklers in areas wherein obstructions are present. In addition, as a conventionally sized warehouse or storage facility may contain many different types of obstructions, the installation of sprinkler systems in these facilities is often a complex procedure. Moreover, in certain circumstances, adherence to NFPA 13 (1996 ed.) §4-11.5.2, and the various sections of NFPA 13 (1999 ed.) has resulted in particular areas receiving only a marginal quantity of water and thus, are particularly vulnerable to the generation and growth of a fire. That is, in order to satisfy the above cited sections of NFPA 13, it is often necessary to place a sprinkler head on both sides of the obstruction. Consequently, when the site of ignition is directly, or approximately directly, under the obstruction, only the outer periphery of the spray distribution pattern of both the sprinkler heads reach the conflagration. As a result, fires generated proximate to these obstructions have an increased opportunity to grow and spread to adjoining areas given the often marginal protection afforded by the pair of sprinkler heads.

Consequently, there exists a need for a fast response, upright sprinkler which can effectively provide a spray distribution pattern when used in proximity to obstructions and can provide the necessary ADD values required to suppress or extinguish a fire.

SUMMARY OF THE INVENTION

Accordingly, the present invention is embodied in a fast response upright sprinkler head. The sprinkler head, according to one aspect of the invention, includes a sprinkler body configured for attachment to a fire extinguishing fluid supply line. The sprinkler body is formed with an orifice in fluid communication with the fire extinguishing fluid supply line, and has a K value of at least approximately 13.5. A fusible trigger assembly, coupled to the sprinkler body, exerts a sealing force upon a sealing assembly and has a fusing temperature of between approximately 155° F. and 175° F. Providing an upright sprinkler head having both a K value of at least 13.5 and a fusible trigger assembly responsive in the temperature range of between 155° F. and 175° F. results in a fast response sprinkler which may be used in applications where suppression and/or extinguishment of a fire, in contrast to control thereof, is required.

According to another aspect of the present invention, a fire sprinkler system is provided for suppressing a fire in an enclosure, wherein the enclosure contains at least one generally horizontal obstruction of a preselected dimension positioned below the ceiling, and above the floor. The enclosure contains a particular commodity classification, and the fire sprinkler system includes a fire extinguishing fluid supply line having a diameter less than or equal approximately 3.0 inches. At least one upright sprinkler head is attached to the fluid supply line and in fluid communication therewith. The upright sprinkler head is positioned along the fire extinguishing fluid supply line such that the lateral or horizontal distance between the upright sprinkler head and the obstruction is less than approximately three times the width or outer diameter of the obstruction, depending upon the shape of the obstruction. The use of an upright sprinkler head which is placed a horizontal distance less than approximately three times the width or outer diameter of the obstruction reduces the complexity involved in the installation of a sprinkler system and provides increased protection for enclosures having obstructions.

According to yet another aspect of the invention, a method for suppressing a fire in an enclosure having at least one generally horizontal obstruction supported a preselected distance below the ceiling includes the steps of providing a fire extinguishing fluid supply line within the enclosure having a diameter less than or equal to approximately 3.0 inches and attaching at least one upright sprinkler to the fire extinguishing fluid supply line. The upright sprinkler has a K value greater than or equal to approximately 13.5, and a fusible trigger assembly having a fusing temperature between approximately 155° F. and 175° F. Utilizing an upright sprinkler having a K value greater than 13.5 and a trigger assembly having a fusing temperature in the range of 155° F. to 175° F., in combination with a 3.0 inch or less diameter fluid supply line, provides an effective method for extinguishing or suppressing a fire.

According to still yet another aspect of the present invention, an upright sprinkler head is disclosed having a sprinkler body configured for attachment to a fire extinguishing fluid supply line and having a K value of at least approximately 13.5. A deflector is coupled to the sprinkler body and has an impact surface configured to generate an optimum spray distribution pattern of fire extinguishing fluid over an area to be protected. The deflector includes a generally planar member having a perimeter and a skirt depending outwardly therefrom at a preselected angle from the vertical, which is between approximately 12° and 26°. An annular ledge extends horizontally from the skirt. The combination of a K value of at least 13.5 and a deflector having a planar member, a skirt depending outwardly therefrom at a preselected angle, and an annular ledge provides an effective upright sprinkler head for use in suppressing or extinguishing a fire.

According to still yet another aspect of the invention, a fire sprinkler system for use in suppressing a fire in an enclosure having at least one generally horizontal obstruction with a preselected dimension positioned below the ceiling and above the floor, and containing a particular commodity classification includes a fire extinguishing fluid supply line having a diameter less than or equal to approximately 3.0 inches, and at least one upright sprinkler having a deflector and extending from the fire extinguishing fluid supply line. The at least one upright sprinkler includes a K value of at least approximately 13.5, and includes a fusible trigger assembly having fusing temperature between approximately 155° F. and 175° F. The deflector of the at least one upright sprinkler is positioned a preselected vertical distance above the bottom of the obstruction. Utilizing the upright sprinkler head of the present invention permits its placement a horizontal distance above the obstructions, which in turn greatly simplifies the installation of the sprinkler system and thus reduces costs.

According to a further aspect of the invention, a fusible link for a sprinkler head having a first lever and a second lever comprises a first plate formed with a first channel and at least one air aperture, and a second plate formed with a second channel and at least one air aperture. A layer of head fusible material joins the first and second plate. The first and second channel extend in opposite directions and the at least one air aperture of the first plate is in registration with the at least one air aperture of the second plate when the fusible link is in the assembled condition. The use of registering air apertures in the fusible link provides air passages to increase the convective heat flow through the fusible link, and hence increases response time, enabling the fusible link to be used in applications wherein fast response is necessary to suppress or extinguish a fire.

The present invention provides a fast response upright sprinkler head capable of discharging a sufficient output of water or other fire extinguishing fluid, and effectively alters the trajectory of the water so as to develop a spray distribution pattern about a preselected area. The spray distribution pattern generated by the sprinkler head of the present invention provides an ADD in excess of the RDD for a given fuel package, and thus permits the sprinkler head to be used in commercial or industrial warehouse applications requiring fire suppression. Additionally, by using the fast response upright sprinklers of the present invention, a fire extinguishing system can be implemented wherein the fast response upright sprinkler head is placed in proximity to, and horizontally above, an obstruction. The ability to place the fast response, upright sprinkler head in proximity to these obstructions enables the fast response upright sprinkler head to provide an optimum spray distribution pattern about the obstruction and thereby provides greater fire protection in the event a fuel package is ignited directly below or approximately directly below the obstruction.

These and other features and advantages of the present invention will be further understood and appreciated by those skilled in the art by reference to the following specification, claims, and drawings.

BRIEF DESCRIPTION OF THE DRAWINGS

FIG. 16 is a table depicting the test parameters and test results for a fire sprinkler system test conducted by the Factory Mutual Research Corporation and utilizing upright sprinkler heads according to the present invention;

FIG. 17 is a reprint of Table 5-11.5.1 referenced in §§5-11.5.1, and 5-11.5.3 of NFPA 13 (1999 ed.); and FIG. 18 is a reprint of FIG. 5-11.5.1 referenced in §5-11.5.1 of NFPA 13 (1999 ed.).

DETAILED DESCRIPTION OF PREFERRED EMBODIMENTS

Figure 1:
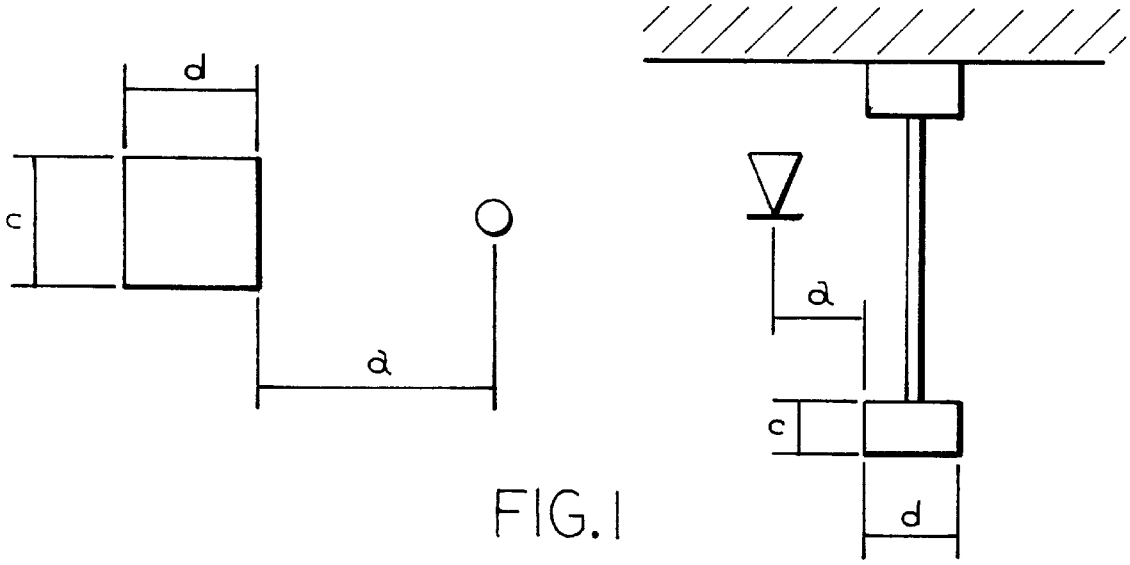
FIG. 1 is a reprint of FIG. 4-11.5.2 referenced in §4.11.5.2 of NFPA 13, 1996 Edition.

According to one aspect, the present invention is embodied in a fast response upright sprinkler head. The fast response upright sprinkler head generates a sufficient flow rate of water during the initial stage of fire development and develops an optimum spray distribution pattern capable of delivering an actual delivered density in excess of the required delivered density for a given fuel package to thereby permit a fire to be suppressed or extinguished. Although the sprinkler head of the present invention may be used to protect any area, it is particularly suited for use within a commercial or industrial warehouse where the ceiling may reach a height of approximately 30 feet, and the height of storage or product contained within the warehouse may reach a height of approximately 25 feet.

Referring now to FIGS. 2 through 6, a preferred form of a fast response upright sprinkler head 10 is shown and consists of a sprinkler frame or body 20, and a fluid deflector 30 positioned a pre-selected distance from top region 22 of sprinkler body 20 by a yoke 40. A fusible link or trigger assembly 60 is mounted between sprinkler body 20 and deflector 30.

Sprinkler body 20 includes an externally threaded bottom region 24, allowing sprinkler body 20 to be rotatably attached to a fire extinguishing fluid supply line or pipe. A central orifice 26 is formed in sprinkler body 20. Central orifice 26 provides a fluid flow passageway enabling the expulsion of fire extinguishing fluid from outlet 27 of central orifice 26 in response to a fire.

A pair of arcuately shaped frame arms 42 and 44 extend from exterior surface 21 of sprinkler body 20 and project beyond top region 22. Arcuate frame arms 42 and 44 define yoke 40. Apex 46 of yoke 40 is formed with a central member or boss 48 having formed therethrough an internally threaded aperture or bore 49. A conically shaped protrusion 47 extends from surface 45 of both arms 42 and 44 of yoke 40. The purpose of protrusions 47 is to prevent contact between arms 42, 44 and fusible trigger assembly 60. Fusible trigger assembly 60 consists of a male arm or lever 62, a complimentary female arm or lever 64 and a fusible link 66. End 63 of male lever 62 engages a sealing assembly 70 positioned in sealing contact with outlet 27 of sprinkler body 20. End 65 of female lever 64 is positioned in contact with a threaded screw 50 positioned in threaded bore 49 of boss 48.

Fusible link 66 may be any thermally responsive fusible link commonly utilized in the industry having a fusing temperature within the range required by early suppression fast response sprinkler heads. As used herein, "fusing temperature" means the temperature at which the adhesive or solder used in fusible link 66 liquefies, causing the release of trigger assembly 60, and thereby the actuation of sprinkler head 20. In order to permit sprinkler body 20 to deliver an appropriate quantity of fire extinguishing fluid during the initial stages of fire development, fusible link 66 may be any fusible link having a fusing temperature of between approximately 155° F. and 175° F., more preferably between approximately 159° F. and 171° F., and most preferably, approximately 165° F.

Figure 2:
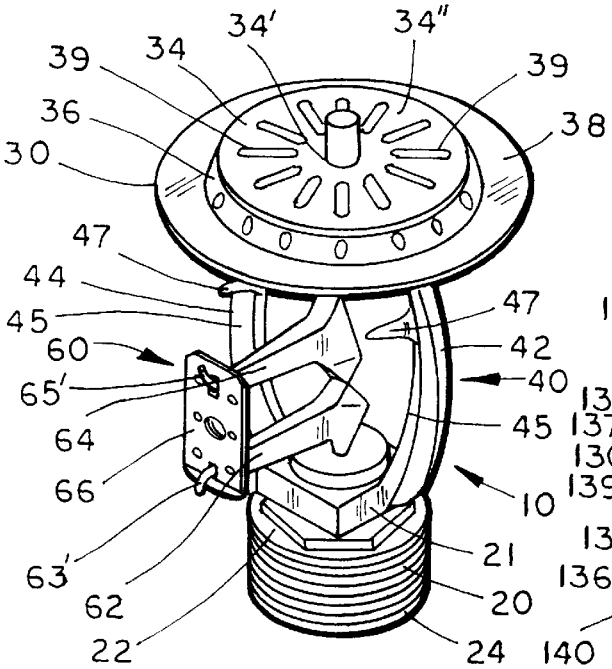
FIG. 2 is a perspective view of a fast response upright sprinkler head according to a preferred embodiment of the invention.
Figure 2A:
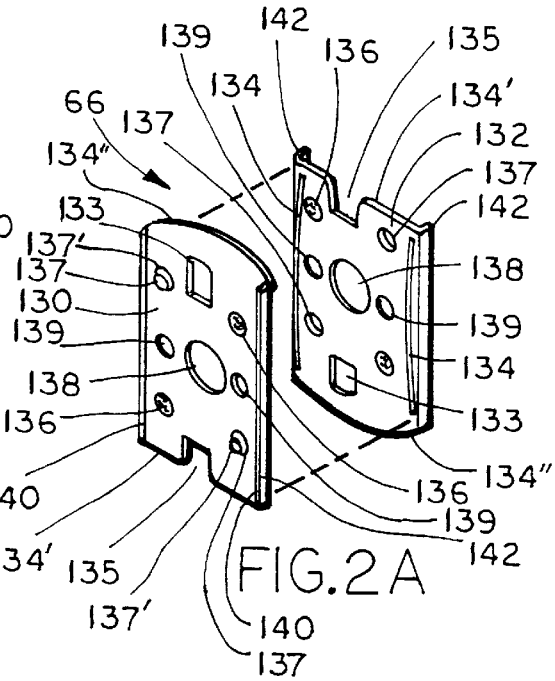
FIG. 2*a* is an exploded perspective view of the fusible link of the fast response upright sprinkler head depicted in FIG. 2.

As shown in FIG. 2*a*, in a preferred embodiment, fusible link 66 includes a pair of plates 130, 132, joined by a fusible material 134. Each plate includes a lever aperture 133 and a channel 135. The plates 130, 132 are positioned in a partially overlapping relationship such that lever aperture 133 formed in plate 130 is in registration with the channel 135 of plate 132, while channel 135 of plate 130 registers with lever aperture 133 of plate 132. That is, when fusible link 66 is in the assembled position, channels 135 of plates 130, 132 extend in opposite directions. Ends 134' of plates 130 and 132 are preferably linear, while ends 134" are preferably arcuate in shape. Each plate 130, 132 is formed with one or more indentations 136 and one or more protrusions 137. Protrusions 137 are tapered and have a central aperture 137'. When assembled, indentations 136 of one plate 130 or 132 are in registration with protrusions 137 of the other plate 130 or 132. Registry of the indentations and depressions between plates 130, 132 facilitates separation of the plates 130, 132, when the desired temperature is reached. Sides 140 of plate 130, 132 have extending therefrom a flange 142. When in the assembled condition, flanges 142 of plates 130, 132 extend in opposite directions. Flanges 142 act as thermal barriers to partially trap heat about the surfaces of fusible link 66 and as a result, increase the response time of fusible link 66.

Each plate 130, 132, includes a center hole 138 placed in registration with the center hole 138 of the other plate 130, 132. One or more air apertures 139 are formed in each plate 130 and 132, and positioned in registration with the opposing air aperture 139 formed in plate 130, 132. Center hole 138 and air apertures 139, enable the migration of air through fusible link 66 to thereby result in the timely separation of plates 130, 132, when the appropriate temperature is reached in response to a fire. Fusible link 66 of FIG. 2*a* is a link usable in various styles of sprinkler heads, and in certain conventional sprinkler heads, center hole 138 of fusible link 66 provides an access aperture through which an adjustment screw may be reached by an adjustment tool. Air apertures 139, however, do not provide access apertures for tools or mounting points for sprinkler assembly components. Rather, air apertures 139 are preferably provided in addition to other functional apertures such as center hole 138 for the purpose of speeding trigger response time. While not wishing to be bound by theory, it is believed that the presence of air apertures 139 and center hole 138 enables fusible link 66 to experience a continuous air flow therethrough in order to increase the convective heat transfer to plates 130, 132, increasing the rate at which fusible link 66 is elevated to a specified temperature. Furthermore, it is believed that reducing the mass of plates 130, 132 decreases the activation time necessary to separate plates 130, 132 in response to a fire. Preferably, a plurality of air apertures 139 are provided and are positioned and spaced on plates 130, 132 in order to maximize the ambient heat infusion into plates 130, 132. As shown in FIG. 2*a*, two air apertures 139 are generally centrally located on plates 130, 132. Alternatively, four air apertures 139 may be utilized and spaced across the face of plates 130, 132 in a rectangular pattern. In still other alternatives, one air aperture 139 or other number of air apertures 139 greater than two may be used.

Sealing assembly 70 includes a sealing ring 72, an arcuately shaped hollow plug 76 and an insert member 78. Sealing ring 72 is placed within outlet 27 of sprinkler body 20 and is supported by a shoulder 23. Sealing ring 72 contains a central aperture 73 dimensioned to receive plug 76. When assembled, region 76' of plug 76 projects a preselected distance within central orifice 26. Plug 76 is formed with a shoulder 77 supported by sealing ring 72. The interior of plug 76 is dimensioned to receive insert member 78. When in position, insert member 78 is supported by interior surface 77' of shoulder 77. Top surface 79 of insert member 78 is formed with a depression 80 dimensioned to receive end 63 of male lever 62.

To attach fusible trigger assembly 60 to sprinkler head body 20, sealing assembly 70 is first positioned within outlet 27 of sprinkler body 20. Thereafter, levers 62 and 64, having fusible link 66 attached to ends 63' and 65' is positioned so that end 63 of male lever 62 is positioned within depression 80 of insert member 78. Threaded screw 50 is then placed within threaded bore 49 of boss 48 and rotated until threaded screw 50 contacts end 65 of female lever 64. Threaded screw 50 is rotated until a sufficient force is applied to female lever 64 to thereby hold fusible trigger assembly 60 securely in place and provide a fluid tight seal against outlet 27 of sprinkler body 20. To prevent threaded screw 50 from rotating subsequent to achieving the proper position, interior surface 51 of bore 49 is lined with an adhesive. Thereafter, a pin or pintle 85 is placed in bore 49 to thereby identify sprinkler head as a non-standard orifice/thread size sprinkler. The adhesive used to secure pintle 85 within bore 49 may be any adhesive commonly used by those with ordinary skill in the art. In the preferred form, an anaerobic adhesive is utilized. Alternatively, pintle 85 may be eliminated and the necessary information stamped on an exterior surface of deflector 30.

Deflector 30 assumes a general cap-like shape and includes a horizontal top or planar member 34. A downwardly projecting annular member or skirt 36 depends from the periphery of planar member 34 in a frusto-conical configuration. Annular skirt 36 depends outwardly, away from planar member 34 at a pre-selected angle "a" off the vertical, shown in FIG. 5. Preferably, angle "a" is between approximately 12° and 26°, more preferably between 15° and 23°, even more preferably between 18° and 20°, and most preferably 19°. Although not wishing to bound by theory, it is believed that the angle assumed by annular skirt 36 contributes to the development of an optimum spray distribution pattern which enables upright sprinkler head 10 to deliver a spray distribution pattern sufficient to suppress or extinguish a fire in a protected area.

Figure 6:
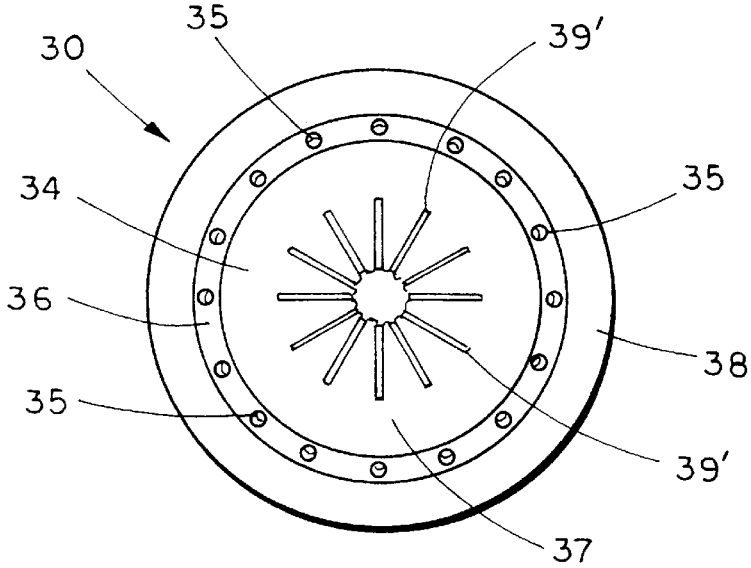
FIG. 6 is a bottom view of the deflector of FIG. 2.

A plurality of spaced apertures or through-holes 35 are formed along annular skirt 36. Through-holes 35 enable water to pass therethrough and in doing so, accelerates the water outwardly, away from annular skirt 36, to provide a spray distribution pattern having a larger diameter and thus a greater area of coverage. A generally horizontal annular flange or ledge 38 extends from annular skirt 36. Annular ledge 38 provides a fluid barrier to prevent water from assuming a linear trajectory and impacting the ceiling or other structure positioned above deflector 30. Planar member 34 may be flat with a substantially planar outer surface 34". Alternatively, outer surface 34" of planer member 34 is formed with a plurality of indentations or depressions 39. As shown in FIG. 6, depressions 39 result in the formation of linear ribs 39' on inner surface 37 of planar member 34. Ribs 39' impart strength upon planar member 34. Preferably, ribs 39' extend from the central region of planar member 34 in a radial pattern. Most preferably, twelve ribs 39' are arrayed outwardly to a circle approximately 1.281 inches (32.54 millimeters) in diameter. Each rib 39' is approximately 0.47 inches (11.93 millimeters) long. In the most preferred embodiment, planer member 34 has an outer diameter of approximately 1.965 inches (49.91 millimeters) and annular skirt 36 has a vertical height of approximately 0.31 inches (7.92 millimeters). Most preferably, annular ledge 38 is ring-shaped with an inner diameter of approximately 2.180 inches (55.372 millimeters) and an outer diameter of approximately 2.895 inches (73.53 millimeters). Also, in the most preferred embodiment, sixteen through-holes 35 have an oval shape with a major dimension running vertically and having an approximate length of 0.230 inches (5.84 millimeters), and a minor horizontal dimension of approximately 0.130 inches (3.30 millimeters). Planar member 34 is preferably spaced between approximately 2.089 inches (53.05 millimeters) and 2.044 inches (51.91 millimeters) above outlet 27, and most preferably is spaced approximately 2.0625 inches (52.3 millimeters) above outlet 27.

Figure 4:
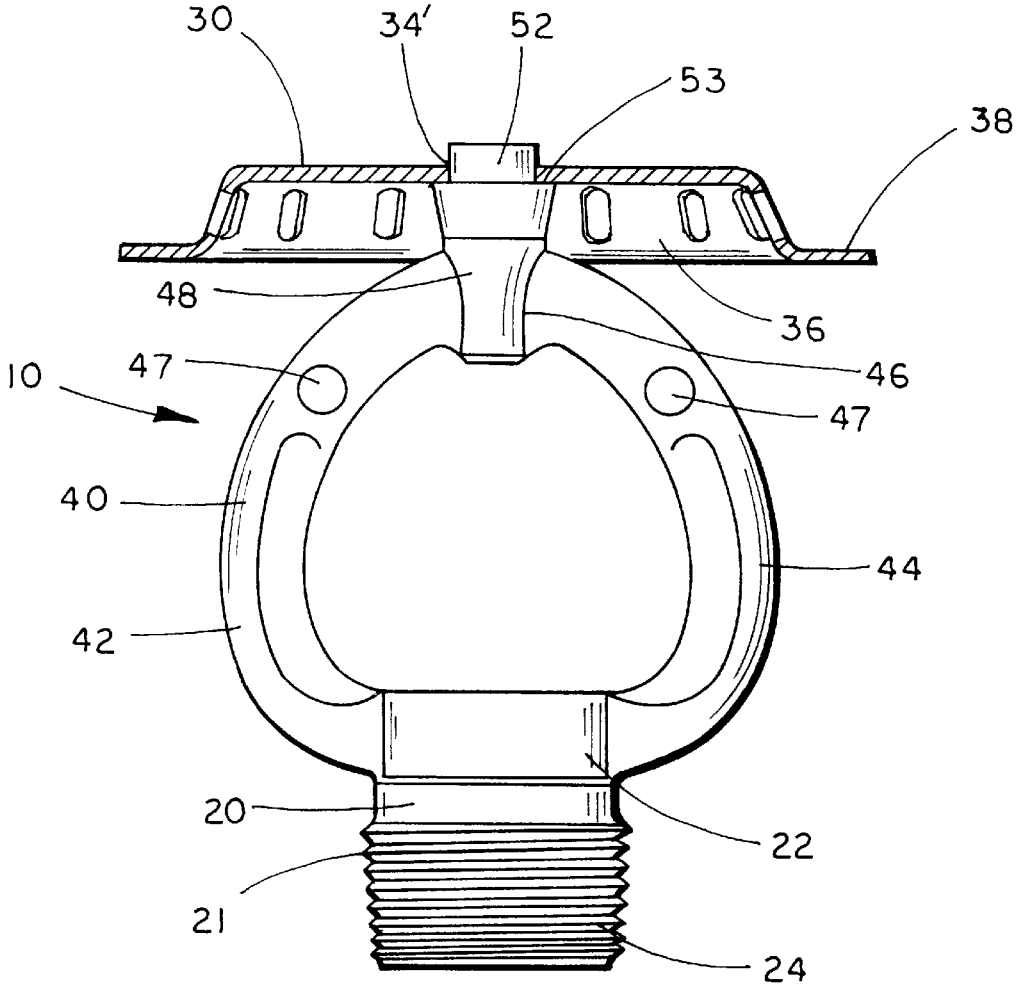
FIG. 4 is a perspective view illustrating the placement of the deflector of FIG. 2 on the sprinkler body.
Figure 5:
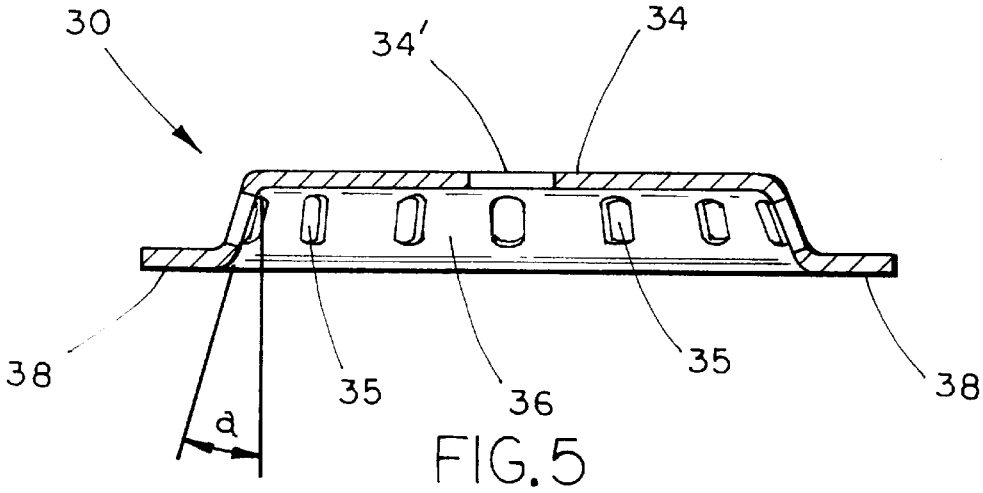
FIG. 5 is a detailed sectional view of the deflector of FIG. 2.
Figure 7:
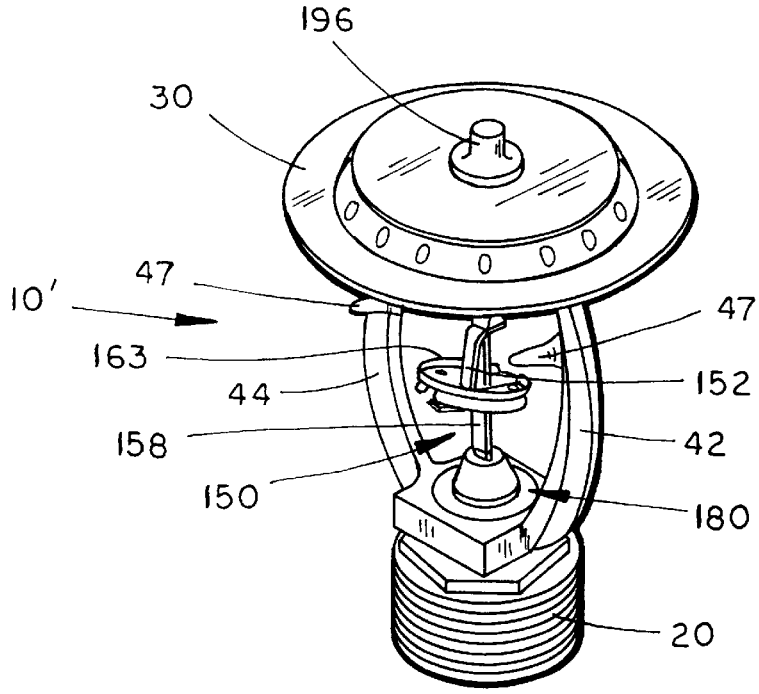
FIG. 7 is a perspective view of a fast response upright sprinkler head according to an alternative preferred embodiment of the present invention.

Referring now to FIG. 4, planar member 34 of deflector 30 is formed with a central aperture 34', while boss 48 is formed with an annular lip 52. To attach deflector 30 to sprinkler body 20, deflector 30 is positioned over lip 52 of boss 48, and is supported by shoulder 53. Thereafter, annular lip 52 is bent in a downward direction to thereby secure deflector 30 to boss 48. The bending of annular lip 52 about deflector 30 may be achieved by any means commonly utilized in the art, for example, crimping or orbital riveting.

Turning now to FIGS. 7 through 11, there is shown a fast response upright sprinkler head 10 according to an alternative preferred embodiment of the present invention. Upright sprinkler head 10 includes a fusible trigger assembly 150, a sealing assembly 180 and a cruciform shaped pintle 196. Fusible trigger assembly 150 includes a first pin 152, a second pin 158, and a fusible link 163. Fusible link 163 may be any thermally responsive fusible link commonly utilized in industry having a fusing temperature between approximately 155° F. and 175° F., more preferably between approximately 159° F. and 171° F., and most preferably, approximately 165° F.

Figure 11:
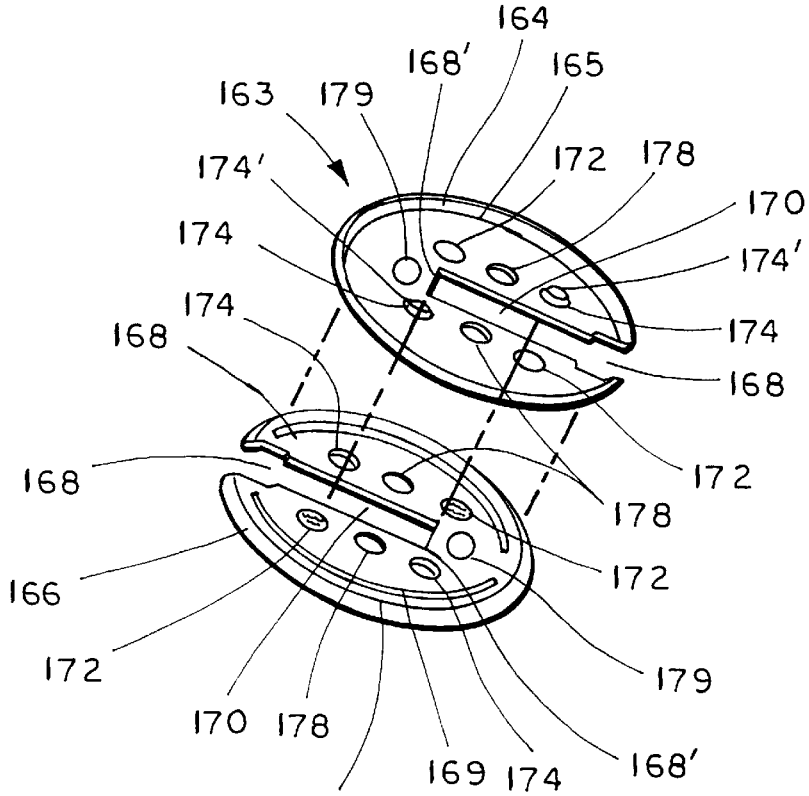
FIG. 11 is a exploded perspective view of the fusible link of the fast response upright sprinkler head of FIGS. 7 and 8.

In a preferred embodiment, as shown in FIG. 11, fusible link 163 includes a pair of plates 164 and 166 joined by a fusible material 169. Each plate 164 and 166 includes a channel 168 having a length greater than the radius of plate 164 and 166 such that when assembled, channels 168 define a center slot 170 dimensioned to receive first pin 152 and second pin 158. Each plate 164, 166 may have one or more depressions 172, and protrusions 174 such that when assembled, the protrusions 174 of one plate 164, 166 are in registration with the depressions 172 of the opposing plate 164, 166. Protrusions 174 are tapered and have a central aperture 174'. Each plate 164, 166 is also formed with one or more air apertures 178 in registration with air apertures 178 in the opposing plate 164, 166. As discussed with respect to fusible link 66 hereinabove, air apertures 178 facilitate the timely separation of plates 164, 166 in response to a fire. Although center slot 170 provides a mounting location and access passage through fusible link 163 for pins 152, 158, air apertures 178 provide the function of speeding response time and preferably do not provide mounting points for components or access apertures for tools. Preferably, a plurality of air apertures 178 are provided and are radially spaced about plates 164, 166 in order to provide air passages or conduits through fusible link 163. In alternative embodiments, one air aperture 178 or more than two air apertures 178 may be used. Preferably each plate 164, 166 is formed with a rim 176 and 176' respectively, such that when assembled, rims 176 and 176' extend in opposite directions. Rims 176 and 176' act as a thermal barrier to trap air about the surfaces of fusible link 163 and thus increase response time.

In the most preferred embodiment, each plate 164, 166 includes one or more first air apertures 178, and a second air aperture 179. Second air apertures 179 are positioned between perimeter 165 of plates 164, 166 and end 168' of channel 168. Most preferably, second air apertures 179 have a major dimension or diameter greater than the major dimension or diameter of air apertures 178. In the most preferred embodiment, first air apertures 178 have a diameter of approximately 0.094 inches, while second air apertures 179 have a diameter of approximately 0.125 inches.

Figure 9:
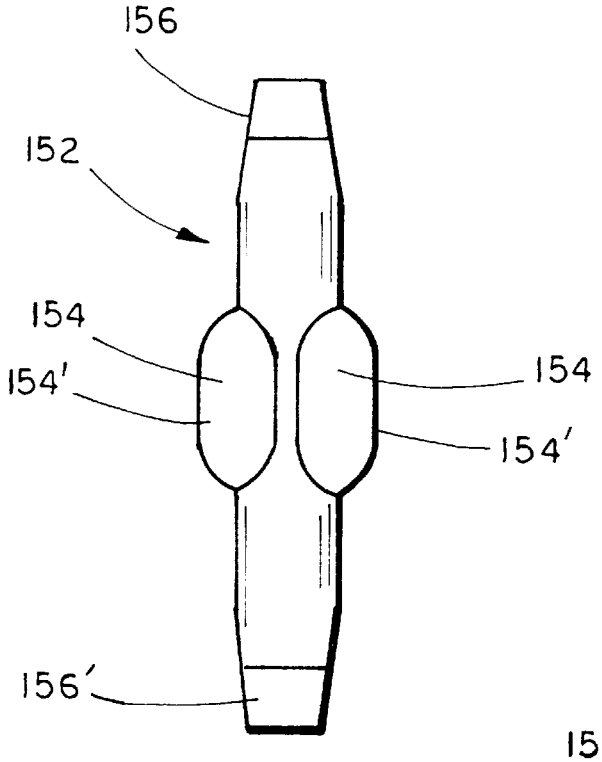
FIG. 9 is a front view of a pin of the fast response upright sprinkler head of FIGS. 7 and 8.
Figure 9A:
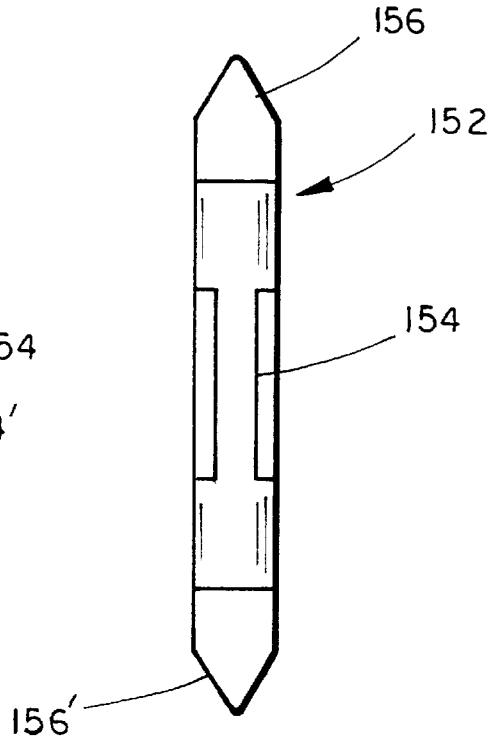
FIG. 9*a* is a side view of the pin depicted in FIG. 9.
Figure 10:
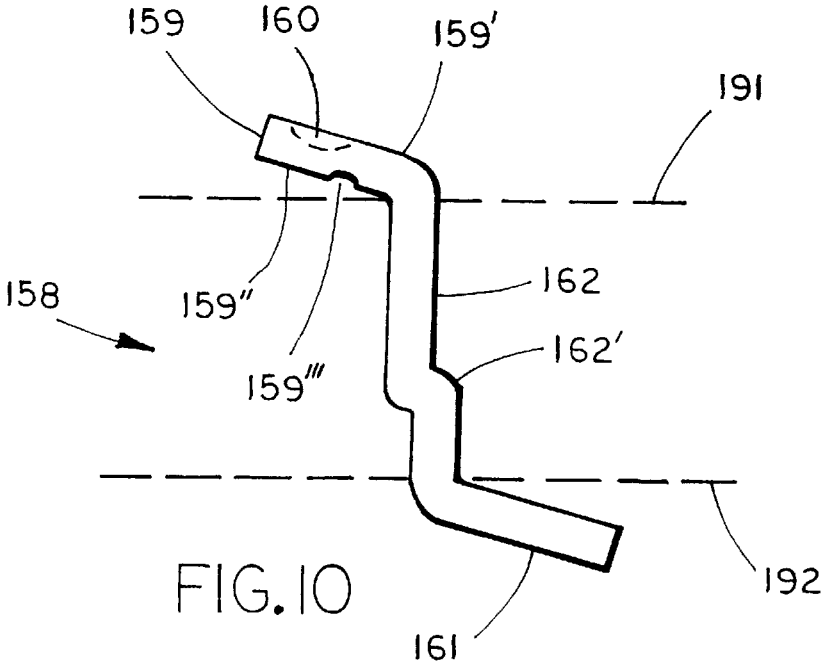
FIG. 10 is a perspective view of the other pin of the fast response upright sprinkler head depicted in FIGS. 7 and 8.

As shown in FIGS. 9 and 9*a*, first pin 152 is substantially linear with a pair of generally arcuate protrusions 154 extending beyond the width of first pin 152. First pin 152 contains a pair of opposing ends 156 and 156', each of which is tapered. As shown in FIG. 10 , pin 158 assumes a largely S-shaped configuration, having a top member 159, a bottom member 161, joined by a middle member 162. Top member 159 extends at a preselected angle above the horizontal, indicated by the dotted line 191 in FIG. 10 . Bottom member 161 extends at a preselected angle below the horizontal, illustrated as the dotted line 192 in FIG. 10 . Top member 159 has a top surface 159' formed with a depression 160, while bottom surface 159" of top member 159 is formed with a notch 159"'. Middle member 162 includes a ledge 162'. However, it will be understood by those with ordinary skill in the art that middle member 162 may also be formed having a linear cross-section, without departing from the spirit and scope of the invention. Top member 159 and bottom member 161 project in different directions.

Figure 8:
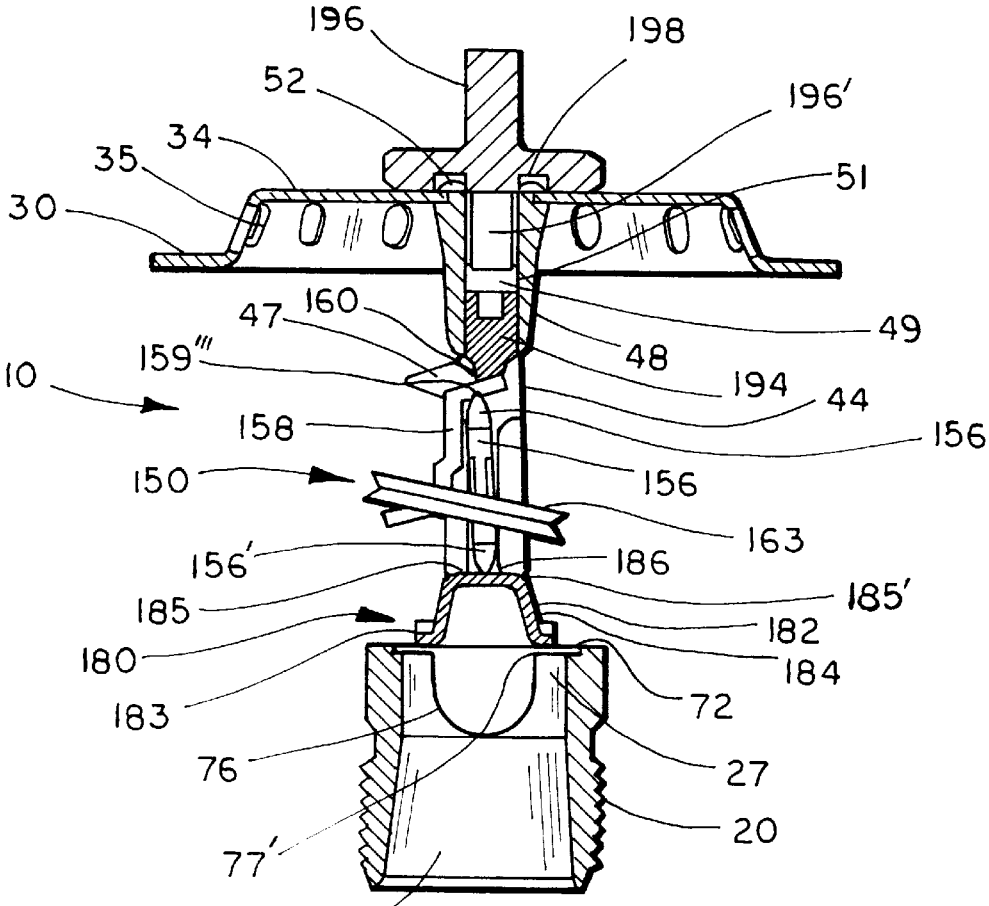
FIG. 8 is a sectional view of the fast response upright sprinkler head of FIG. 7, taken along line VIII—VIII of FIG. 7.

As depicted in FIG. 8, sealing assembly 180 includes sealing ring 72, arcuately shaped hollow plug 76, and an insert member 182. Insert member 182 includes a generally horizontal rim 183, which is supported by shoulder 77' of hollow plug 76, and a circular ledge 184 extending from rim 50 in a direction away from outlet 27 of sprinkler body 20. Circular ledge 184 has a tapered configuration tapering away from outlet 27 of sprinkler body 20. Insert member 182 also contains a top member 185 attached to ledge 184. Formed in top surface 185' of top member 185 is a notch or depression 186 dimensioned to receive end 156' of first pin 156.

An externally threaded screw 194 is positioned within threaded bore 49 of boss 48. Section 196' of a cruciform shaped pintle 196 is positioned within threaded bore 49 of boss 48 to prevent threaded screw 194 from rotating subsequent to achieving the proper position. Cruciform shaped pintle 196 includes an annular bore 198 dimensioned to receive annular lip 52 of boss 48. Preferably, screw 194 is an Allen screw. Both screw 194 and section 196' of cruciform shaped pintle 196 may be secured within bore 49 of boss 48 by any adhesive commonly utilized in the art.

In assembling upright sprinkler head 10 , sealing assembly 180 is positioned within the outlet 27 of sprinkler body 10 . Fusible trigger assembly 150 is assembled by inserting first pin 152 into center hole 170 defined by plates 164 and 166, with end 156' resting within depression 186 formed in top surface 185' of insert member 182. Thereafter, second pin 158 is positioned through center hole 170 such that the fusible link 163 rests at the intersection of middle member 162 and bottom member 161. End 156 of first pin 152 is then inserted in notch 159"' positioned in top member 159 of second pin 158. Subsequently, screw 194 is inserted in bore 49 and rotated until end 194' is positioned within depression 160 of top member 159 of second pin 158. Rotation of the screw 194 upon second pin 158 exerts a force, resulting in the slight upward movement of fusible link 163 and the sealing engagement of sealing assembly 180 within outlet 27. Deflector 30 is then placed over boss 48 and annular lip 52 is bent to secure deflector 30 to boss 48. Thereafter, section 196' of cruciform shaped pintle 196 is inserted within bore 48, and held there by the use of an appropriate adhesive secured to the exterior surface of section 196' of pintle 196 or the interior surface 51 of bore 49.

In the assembled position, fusible link 163 will be supported by first pin 152 and second pin 158 at a preselected angle off the horizontal. Furthermore, it will be recognized that the distance between the outer edges 154' of protrusions 154 of first pin 152 is greater than the width of channels 168 of plates 164, 166 to thereby prevent movement of fusible link 163 in an upward direction. In all other aspects, upright sprinkler head 10 is structurally similar to upright sprinkler head 10 .

Upright sprinkler head 10 and 10 is configured to have a discharge coefficient or K value of between approximately 13.5 and 14.5, and preferably, approximately 14.0 at 175 psi fluid pressure. Most preferably, outlet 27 is 0.704 inches (17.88 millimeters) in diameter. This K value, in combination with deflector 30, enables upright sprinkler head 10, 10' to produce large, high momentum water droplets in a hemispheric pattern below deflector 30. The size and momentum of the water droplets permits penetration of the fire plume and direct wetting of the fuel package surface in order to successfully suppress or extinguish a fire.

In another aspect, the present invention is embodied in a fire sprinkler system and method for use in the protection of industrial or commercial enclosures, wherein the enclosure contains at lease one obstruction depending from, supported by, or otherwise placed a pre-selected distance below the ceiling. The fire sprinkler system and method of the present invention is particularly suited for protecting enclosures containing palletized and solid pile storage and single, double, multiple row and portable rack storage fixtures.

Turning now to FIGS. 12 through 15, there is shown a building or enclosure 95 containing the fire sprinkler system of the present invention. Enclosure 95 contains a ceiling 106 and a floor 108. Positioned a pre-selected distance below ceiling 106 is one or more fire extinguishing fluid supply lines 110. Fire extinguishing fluid supply lines 110 are in fluid connection with a source of fire extinguishing fluid (not shown). Fire extinguishing fluid supply lines 110 have, at regular intervals, internally threaded collars 112 extending from the top region 111. Each internally threaded collar 112 is dimensioned to threadably receive an upright sprinkler head 10 or 10'. Enclosure 95 contains at least one generally horizontal obstruction 120. As used herein, the term "obstruction" shall mean pipes, columns, lighting fixtures, conveyors, ducts or bottom cords of trusses or joints, or any other obstruction not having a continuous solid vertical surface opposing upright sprinkler head 10 or 10'.

Figure 12:
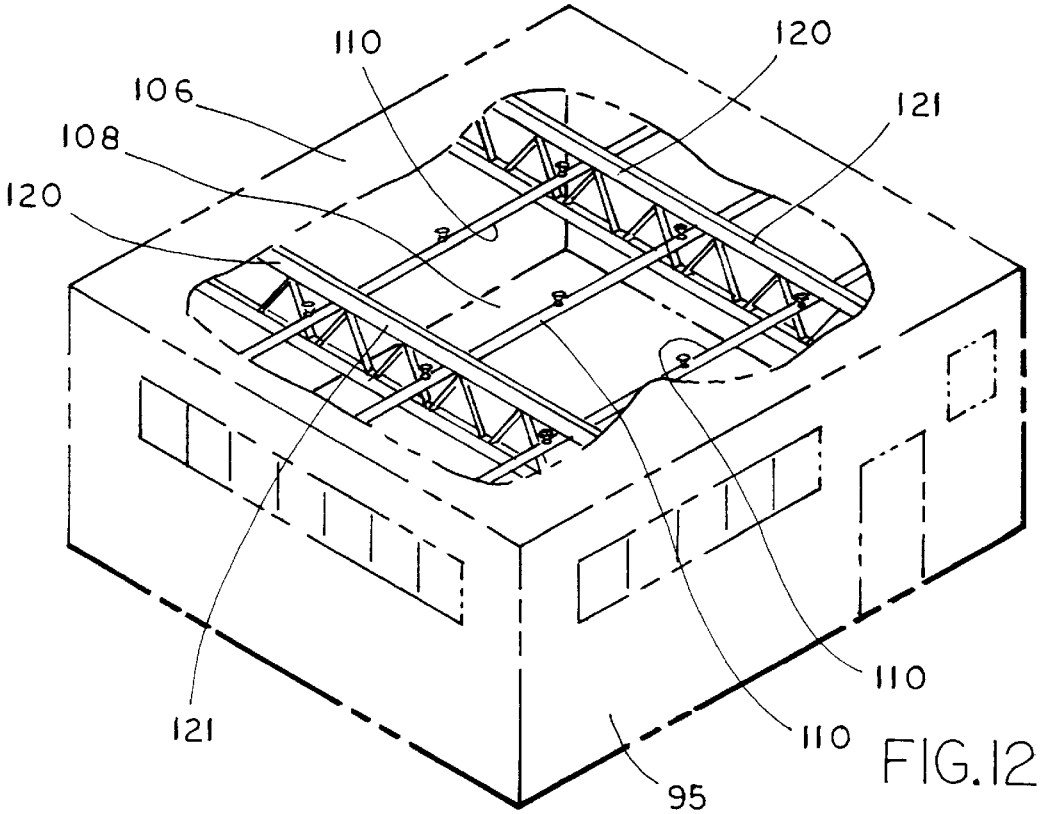
FIG. 12 is a schematic, perspective view of an enclosure having a fire sprinkler system according to a preferred embodiment of the present invention, with a portion of the fire sprinkler system shown in proximity to an obstruction.
Figure 3:
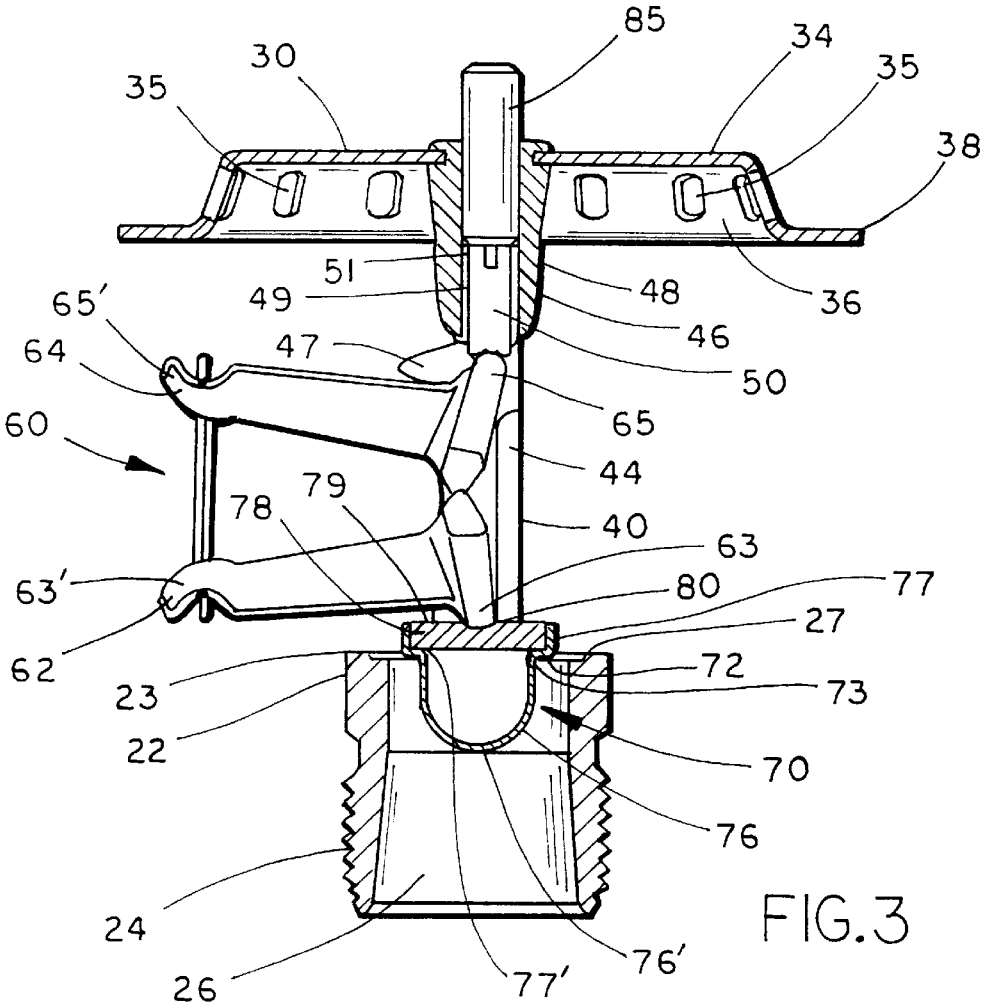
FIG. 3 is a sectional view of the fast response upright sprinkler head of FIG. 2, taken along line III—III of FIG. 2.
Figure 14:
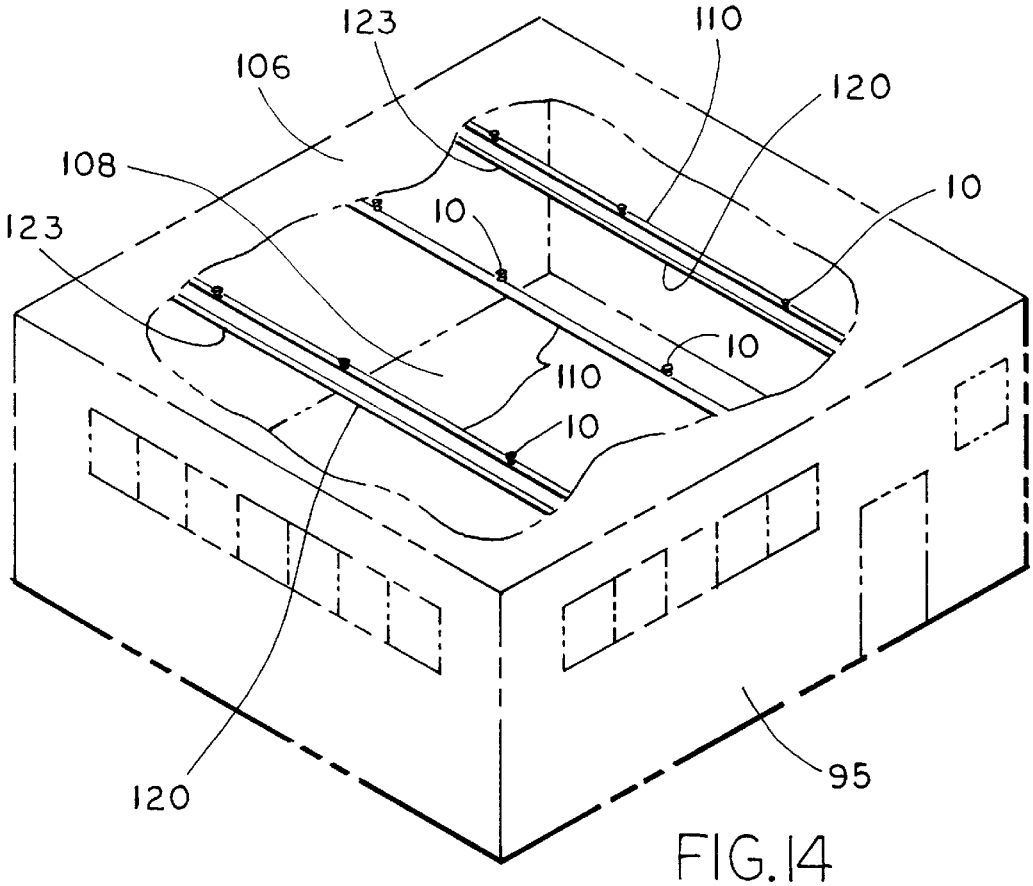
FIG. 14 is the same view of FIG. 12, with a portion of the fire sprinkler system illustrated in proximity to an annularly shaped obstruction.
Figure 15:
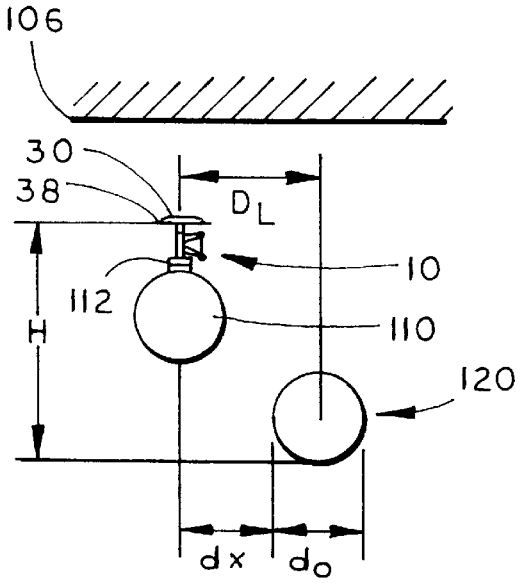
FIG. 15 is a side view illustrating the position of an upright sprinkler head in relation to the annularly shaped obstruction depicted in FIG. 14.
Figure 13:
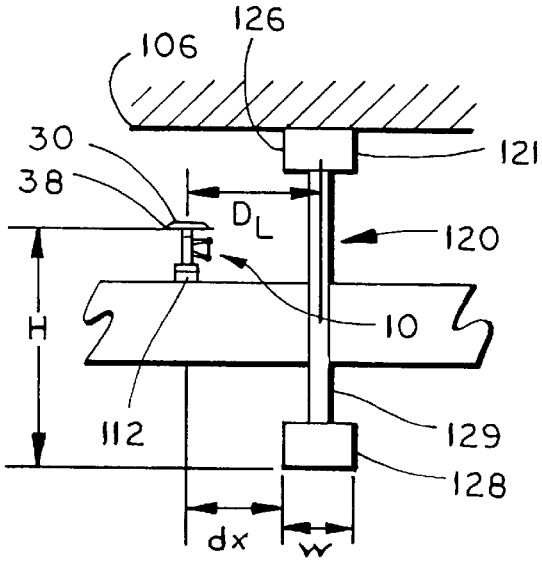
FIG. 13 is a side view illustrating the position of an upright sprinkler head of the fire sprinkler system of FIG. 12 in relation to an obstruction.

As shown in FIGS. 12 and 13, obstruction 120 is shown in the form of a truss 121 having a top cord 126 and a bottom cord 128 coupled by webbing 129. In FIGS. 14 and 15, obstruction 120 is in the form of a pipe 123 or other horizontal member. In the fire sprinkler system of the present invention, when supply lines 110 each have a diameter less than or equal to approximately 3.0 inches, and when enclosure 95 contains class 1 through class 4 or unexpanded plastic carton commodities, or mixtures thereof, and obstruction 120, either bottom cord 128 of truss 121, or pipe 123, has a width (W) or an outer diameter ($d_0$) less than or equal to approximately 4.0 inches, one or more upright sprinkler heads 10 or 10' are positioned in fluid connection with fire extinguishing fluid supply line 110 such that upright sprinkler heads 10 or 10' are positioned such that the horizontal or lateral distance ($D_L$) between a particular sprinkler head 10 or 10' and obstruction 120 is given by the following equation:

$$D_L \leqq 3 \times W;$$

or $$D_L \leqq 3 \times d_0$$

Furthermore, upright sprinkler heads 10 or 10' can be positioned a vertical distance or height H above the obstruction 120 which is greater than zero. That is, with the upright sprinkler head 10 or 10' of the present invention, with the above cited parameters and commodity classifications, NFPA (1999 ed.) 13 §§5-11.5.2, 5-11.5.3, and 5-11.3.2 are not applicable. Specifically, the height H above the bottom of obstruction 120 at which the bottom surface of annular ledge 38 of deflector 30 is placed, depending upon the horizontal or lateral distance ($d_x$) between upright sprinkler head 10 or 10' and the surface of obstruction 120 most proximate to upright sprinkler head 10, 10', is given by the table below:

| Horizontal Distance From Sprinkler to Side of Obstruction ($d_x$) | Vertical Distance of Deflector above Bottom of Obstruction (H) |
|---|---|
| Less than approximately 1 ft | ≧approximately 0.0 inches |
| 1 ft to less than approximately 1 ft 6 in. | ≧approximately 1.5 inches |
| 1 ft 6 in to less than approximately 2 ft | ≧approximately 3.0 inches |
| 2 ft to less than approximately 2 ft 6 in. | ≧approximately 5.5 inches |
| 2 ft 6 in. to less than approximately 3 ft | ≧approximately 8.0 inches |
| 3 ft to less than approximately 3 ft 6 in. | ≧approximately 10.0 inches |
| 3 ft 6 in. to less than approximately 4 ft | ≧approximately 12.0 inches |
| 4 ft to less than approximately 4 ft 6 in. | ≧approximately 15.0 inches |
| 4 ft 6 in. to less than approximately 5 ft | ≧approximately 18.0 inches |
| 5 ft to less than approximately 5 ft 6 in. | ≧approximately 22.0 inches |
| 5 ft 6 in. to less than approximately 6 ft | ≧approximately 26.0 inches |
| 6 ft or greater | ≧approximately 31.0 inches |

When supply lines 110 each have an outer diameter of less than or equal to approximately 3.0 inches, and when enclosure 95 contains expanded plastic carton commodities, and obstruction 120, either bottom cord 128 of truss 121 or pipe 123, has a width (W) or an outer diameter ($d_0$) of approximately 3.0 inches or less, the horizontal or lateral distance ($D_L$) between a particular upright sprinkler head 10 or 10' and obstruction 120 is given by the equation:

$$D_L \leqq 3 \times d_0;$$

or $$D_L \leqq 3 \times W$$

Furthermore, upright sprinkler heads 10 or 10' can be positioned a height H above the obstruction 120 which is greater than zero. That is, with the upright sprinkler head 10 or 10' of the present invention, with the above cited parameters, and commodity classifications, NFPA 13(1996 ed.) §4-11.5.2 and NFPA 13 (1999 ed.) §§5-11.5.2, 5-11.5.3.2 are not applicable. Specifically, the height H above the bottom of obstruction 120 at which the bottom surface of annular ledge 38 of deflector 30 is placed, depending upon the horizontal or lateral distance ($d_x$) between upright sprinkler head 10, 10' and the surface of obstruction 120 most proximate to upright sprinklerhead 10, 10', is given by the table cited above.

While not wishing to be bound by theory, it is believed that the combination of the K factor and the initial upward trajectory of the fire extinguishing fluid, as well as the configuration of deflector 30, enables upright sprinkler head 10 or 10' to deliver an effective spray distribution pattern about and around obstructions having the dimensions as detailed above. The ability to place upright sprinkler head 10 or 10' in proximity to an obstruction 120 permits the fire sprinkler system to effectively suppress a fire ignited directly below, or approximately directly below, obstruction 120. Furthermore, by providing greater fire suppression coverage in the area below the obstruction, a lesser number of upright sprinkler heads 10 or 10' are actuated in response to the fire and thus minimizes unnecessary water usage and the resultant damage to product. Moreover, by eliminating the need to place sprinklers a minimum distance from these obstructions, and at the horizontal plane defined by the bottom of the obstruction, the design and installation of fire sprinkler systems in these facilities is simplified.

EXAMPLE

In a fire sprinkler system test conducted by the Factory Mutual Research Corporation utilizing an array of upright sprinkler heads according to the present invention, and obstructed by a particular bar joist configuration, the upright sprinkler head of the present invention exhibited fire suppression performance for the FMRC standard plastic commodity.

The test was conducted under a 30 foot high ceiling, having depending therefrom a bar joist having a bottom cord approximately four inches in width. Both the ignition location (i.e., the area in which the fire was ignited) and the bar joist were positioned directly under a single upright sprinkler head of the sprinkler head array. The fluid supply line responsible for transporting fluid to the upright sprinkler head located above the ignition location was positioned perpendicular to the bar joist, while its bottom cord was positioned immediately beneath the supply pipe. The commodity tested was FMRC standard plastic commodity. The commodities were stacked in storage arrays having a height of approximately 19.6 feet. The upright sprinkler head positioned over the ignition location was centered to provide a V-shaped clearance between a pair of approximately ¾ inch diameter bar joist connecting rods, such that the distance from the deflector of the upright sprinkler head to either rod was approximately three inches. A summary of the test procedures and results may be seen in FIG. 11.

Using the parameters discussed above and detailed in FIG. 11, a single upright sprinkler head was successful in suppressing the fire. The damage to the storage arrays, and the maximum ceiling temperature, were well within the allowable limits set by the Factory Mutual Research Corporation. Furthermore, it was concluded by this fire test that the upright sprinkler head of the present invention demonstrated fire suppression performance for the FMRC standard plastic commodity.

It is to be understood that the foregoing is a description of the preferred embodiments only. One skilled in the art will recognize that variations, modifications and improvements may be made without departing from the spirit and scope of the invention disclosed herein. The scope of protection is to be measured by the claims which follow and the breath of interpretation which the law allows, including the doctrine of equivalents.

The embodiments of the invention in which an exclusive property or privilege is claimed are defined as follows:

1. An upright early suppression fast response (ESFR) sprinkler head for dispensing fire extinguishing fluid in the event of a fire, comprising:

a sprinkler body configured for attachment to a fire extinguishing fluid supply line, said sprinkler body having an orifice in fluid communication with the fire extinguishing fluid supply line, said orifice having an outlet, said sprinkler body having a top region, said sprinkler body having a K factor value of at least approximately 13.5; and a sealing assembly positioned within said outlet of said orifice;

a fusible trigger assembly coupled to said sprinkler body and said sealing assembly, said fusible trigger assembly having a fusing temperature between approximately 155° F. and 175° F.; and a deflector coupled to said sprinkler body and positioned a preselected distance above said top region of said sprinkler body wherein the extinguishing fluid flows upwardly from said orifice when said sealing assembly is released by said fusible trigger assembly from said outlet, said deflector including a plurality of through-holes wherein said deflector generates a spray distribution through said through-holes radially outward from said deflector whereby said defector is configured to generate a spray distribution pattern of fire extinguishing fluid over an area to be protected.

2. The upright sprinkler head as recited in claim 1, further comprising a yoke attached to said top region of said sprinkler body and extending beyond said top region of said sprinkler body, said yoke having an apex, and wherein said deflector is attached to said apex of said yoke.

3. The upright sprinkler head as recited in claim 1, wherein said deflector further comprises:

a downwardly depending skirt, said skirt including said plurality of through-holes.

4. The upright sprinkler head as recited in claim 3, wherein said deflector includes a generally planar member, wherein said skirt depends from said planar member.

5. A The upright sprinkler head according to claim 1, wherein said fusible trigger assembly comprises:

a first plate having a bottom surface, a first channel and, at least one air aperture;

a second plate having a top surface, a second channel and at least one air aperture, wherein said first channel and said second channel extend in opposing directions and said at least one air aperture of said first plate and said at least one air aperture of said second plate are in registry when said fusible link is in the assembled condition; and a layer of heat fusible material positioned on said bottom surface of said first plate and said top surface of said second plate.

6. The upright sprinkler head as recited in claim 4, wherein said skirt depending from said planar member at a preselected angle from the vertical, said preselected angle being between approximately 12° and 26°.

7. The upright sprinkler head as recited in claim 4, wherein said skirt depending from said planar member at a preselected angle from the vertical, said preselected angle being between approximately 15° and 23°.

8. The upright sprinkler head as recited in claim 4, wherein said skirt depending from said planar member at a preselected angle from the vertical, said preselected angle being between approximately 18° and 20°.

9. The upright sprinkler head as recited in claim 4, wherein said planar member has an inner surface formed with a plurality of ribs.

10. The upright sprinkler head as recited in claim 9, wherein said planar member has a central region, and wherein said plurality of ribs extend from said central region of said planar member in a radial pattern.

11. The upright fire extinguishing sprinkler as recited in claim 2, wherein said fusible trigger assembly is coupled to said yoke.

12. The upright sprinkler head according to claim 1, in combination with a fire extinguishing fluid supply line, said fire extinguishing fluid supply line having a diameter less than or equal to approximately 3.0 inches, and said sprinkler head extending from said fire extinguishing fluid supply line and being in fluid communication with said fire extinguishing fluid supply line, and said deflector of said upright sprinkler head being positioned in a preselected vertical distance above the bottom of at least one obstruction and a preselected horizontal distance from the at least one obstruction.

13. The upright sprinkler head as recited in claim 11, wherein said fusible trigger assembly has a fusing temperature of approximately 165° F.

14. The upright sprinkler head as recited in claim 1, wherein said K value is between approximately 13.5 and 14.5.

15. The upright sprinkler head as recited in claim 11, wherein said fusible trigger assembly further comprises a fusible link including a pair of plates joined by a fusible material, each plate of said pair of plates having at least one air hole formed therethrough, wherein said at least one air hole formed in a plate of said pair of plates is in registration with said at least one air hole formed in the other plate of said pair of plates.

16. The upright sprinkler head as recited in claim 11, wherein said fusible trigger assembly further comprises a fusible link including:

a first plate formed with a first channel, said first channel having a length greater than the radius of said first plate;

a second plate formed with a second channel, said second channel having a length greater than the radius of said second plate;

a layer of fusible material positioned between said first plate and said second plate; and wherein said first channel is in registration with said second channel to thereby define a center hole.

17. The upright sprinkler head as recited in claim 16, wherein said fusible trigger assembly further comprises:

a first pin having a pair of protrusions, wherein said pair of protrusions each have an outer edge, wherein the distance between said outer edges of said pair of protrusions is greater than the width of said center hole; and a second pin.

18. The upright sprinkler head as recited in claim 17, wherein said first pin has a pair of opposing ends, wherein each end of said pair of opposing ends is tapered.

19. The upright sprinkler head as recited in claim 17, wherein said second pin further comprises:

a top member having a first end and an opposing second end;

a middle member having a first end and an opposing second end, said first end of said middle member attached to said second end of said top member; and a bottom member having a first end and an opposing second end, said second end of said middle member attached to said first end of said bottom member.

20. The upright sprinkler head as recited in claim 19, wherein said top member and said bottom member project in opposite directions.

21. The upright sprinkler head as recited in claim 19, wherein said top member extends from said middle member at a preselected angle above horizontal.

22. The upright sprinkler head as recited in claim 19, wherein said bottom member extends from said middle member at a preselected angle below horizontal.

23. The upright sprinkler head according to claim 12, wherein a lateral distance between said upright sprinkler head and the at least one obstruction given by the equation:

$$D_L \leqq 3 \times W;$$

wherein W is the width of the at least one obstruction, or $$D_L \leqq 3 \times d_0;$$

wherein $d_0$ is the outer diameter of the at least one obstruction.

24. The upright sprinkler head according to claim 1, said trigger assembly comprising:

a first plate having a bottom surface, a first channel and, at least one air aperture;

a second plate having a top surface, a second channel and at least one air aperture, wherein said first channel and said second channel extend in opposing directions and said at least one air aperture of said first plate and said at least one air aperture of said second plate are in registry when said fusible link is in the assembled condition; and a layer of heat fusible material positioned on said bottom surface of said first plate and said top surface of said second plate.

25. The upright sprinkler head as recited in claim 24, wherein said first plate is formed having at least one protrusion and said second plate is formed having at least one indentation, wherein said at least one protrusion is in registration with said at least one indentation when said fusible link is in the assembled condition.

26. The upright sprinkler head as recited in claim 24, wherein said first plate and said second plate are each formed having a lever aperture, wherein said lever aperture of said first plate is in registration with said second channel, said lever aperture of said second plate is in registration with said first channel, and wherein said first channel and said second channel define a center slot when said fusible link is in the assembled condition.

27. The upright sprinkler head as recited in claim 24, wherein said first plate and said second plate are generally circular in shape.

28. The upright sprinkler head as recited in claim 26, wherein said first channel has a length greater than the radius of said first plate.

29. The upright sprinkler head as recited in claim 26, wherein said second channel has a length greater than the radius of said second plate.

30. The upright sprinkler head as recited in claim 24, wherein said first plate and said second plate each have a perimeter formed with a rim.

31. The upright sprinkler head as recited in claim 30, wherein said rim of said first plate and said rim of said second plate extend in opposite directions when said fusible link is in the assembled condition.

32. The upright sprinkler head as recited in claim 24, wherein said first plate has a perimeter, wherein said first channel has an end and said at least one air aperture formed in said first plate further comprises at least one first air aperture and a second air aperture, wherein said second air aperture is positioned between said end of said first channel and said perimeter.

33. The upright sprinkler head as recited in claim 32, wherein said at least one air aperture has a major dimension and said second air aperture has a major dimension, wherein said major dimension of said second air aperture is greater than said major dimension of said at least one first air aperture.

34. The upright sprinkler head as recited in claim 33, wherein said at least one second air aperture and said second air aperture are substantially circular, and wherein the diameter of said second air aperture is approximately 0.125 inches and the diameter of said at least one first air aperture is approximately 0.094 inches.

35. The upright sprinkler head as recited in claim 24, wherein said second plate has a perimeter, wherein said second channel has an end and said at least one air aperture formed in said second plate further comprises at least one first air aperture and a second air aperture, wherein said second air aperture is positioned between said end of said second channel and said perimeter.

36. The upright sprinkler head as recited in claim 35, wherein said at least one air aperture has a major dimension and said second air aperture has a major dimension, wherein said major dimension of said second air aperture is greater than said major dimension of said at least one first air aperture.

37. The upright sprinkler head as recited in claim 36, wherein said at least one first air aperture and said second air aperture are substantially circular, and wherein the diameter of said second air aperture is approximately 0.125 inches and the diameter of said at least one first air aperture is approximately 0.094 inches.

38. The upright sprinkler head according to claim 1, further comprising a fire extinguishing fluid supply line having a diameter of less than or equal to approximately 3.0 inches; and said upright sprinkler head extending from said fire extinguishing fluid supply line and include communication with said fire extinguishing supply line, said at least one upright sprinkler being spaced a later distance ($D_L$) to an obstruction wherein $D_L$ is given by the equation $$D_L \leqq 3 \times W;$$

wherein W is the width of the at least one obstruction, or $$D_L \leqq 3 \times d_0;$$

wherein $d_0$ 1 is the outer diameter of the at least one obstruction.

39. The upright sprinkler head as recited in claim 38, wherein said upright sprinkler has a K value of at least 13.5.

40. The upright sprinkler head as recited in claim 38, wherein said upright sprinkler has a fusible trigger assembly, wherein said fusible trigger assembly has a fusing temperature between approximately 155° F. and 175° F.

41. The upright sprinkler head as recited in claim 40, wherein said fusible trigger assembly has a fusing temperature of approximately 165° F.

42. The upright sprinkler head as recited in claim 38, wherein said upright sprinkler further comprises:

a sprinkler body having an orifice and a top region;

a pair of legs extending from said top region of said sprinkler body; and a deflector attached to said pair of legs, said deflector having:

a generally planar member, said planar member having a perimeter, a skirt depending from said perimeter of said planar member at a preselected angle from the vertical, and an annular ledge extending generally horizontally from said skirt.

43. The upright sprinkler head system as recited in claim 42, wherein said preselected angle is between approximately 18° and 20°.

44. The fire sprinkler system as recited in claim 38, wherein said at least one upright sprinkler is positioned between the ceiling and the bottom of the obstruction.

45. The upright sprinkler head as recited in claim 1, further comprising a fire extinguishing fluid supply line positioned within an enclosure, said fire extinguishing fluid supply line having a diameter less than or equal to approximately 3.0 inches; and said upright sprinkler head extending from said fire extinguishing fluid supply line and being in fluid communication with said fire extinguishing fluid supply line, said deflector of said upright sprinkler head positioned a preselected vertical distance above a bottom of the at least one obstruction and a preselected horizontal distance from the at least one obstruction.

46. The upright sprinkler head as recited in claim 45, wherein said preselected vertical distance is greater than approximately zero when said preselected horizontal distance is less than approximately one foot.

47. The upright sprinkler head as recited in claim 45, wherein said preselected vertical distance is greater than approximately 1.5 inches when said horizontal distance is greater than or equal to approximately one foot and less than approximately one foot, six inches.

48. The upright sprinkler head as recited in claim 45, wherein said preselected vertical distance is greater than approximately 3.0 inches when said preselected horizontal distance is greater than or equal to between approximately one foot, six inches and less than approximately two feet.

49. The upright sprinkler head as recited in claim 45, wherein said preselected vertical distance is greater than approximately 5.5 inches when said preselected horizontal distance is greater than or equal to approximately two feet and less than approximately two feet, six inches.

50. The upright sprinkler head as recited in claim 45, wherein said preselected vertical distance is greater than approximately 8.0 inches when said preselected horizontal distance is greater than or equal to approximately two feet, six inches and less than approximately three feet.

51. The upright sprinkler head as recited in claim 45, wherein said preselected vertical distance is greater than, approximately 10 .0 inches when said preselected horizontal distance is greater than or equal to approximately three feet and less than approximately three feet, six inches.

52. The upright sprinkler head as recited in claim 45, wherein said preselected vertical distance is greater than approximately 12.0 inches when said preselected horizontal distance is greater than or equal to three feet, six inches and less than approximately four feet.

53. The upright sprinkler head as recited in claim 45, wherein said preselected vertical distance is greater than approximately 15.0 inches when said preselected horizontal distance is greater than or equal to approximately four feet and less than approximately four feet, six inches.

54. The upright sprinkler head as recited in claim 45, wherein said preselected vertical distance is greater than approximately 18.0 inches when said preselected horizontal distance is greater than or equal to approximately four feet, six inches and less than approximately and five feet.

55. The upright sprinkler head as recited in claim 45, wherein said preselected vertical distance is greater than approximately 22.0 inches when said preselected horizontal distance is greater than or equal to approximately five feet and less than approximately five feet, six inches.

56. The upright sprinkler head as recited in claim 45, wherein said preselected vertical distance is greater than approximately 26.0 inches when said preselected horizontal distance is greater than or equal to approximately five feet, six inches and less than approximately six feet.

57. The upright sprinkler head as recited in claim 45, wherein said preselected vertical distance is greater than approximately 31.0 inches when said preselected horizontal distance is greater than or equal to approximately six feet.

58. An upright sprinkler head for dispensing fire extinguishing fluid in the event of a fire, comprising:

a sprinkler body configured for attachment to a fire extinguishing fluid supply line, said sprinkler body having an orifice in fluid communication with the fire extinguishing fluid supply line, said orifice having an outlet, said sprinkler body having a top region, said sprinkler body having a K factor value of at least approximately 13.5; and a sealing assembly positioned within said outlet of said orifice;

a fusible trigger assembly coupled to said sprinkler body and said sealing assembly, said fusible trigger assembly having a fusing temperature between approximately 155° F. and 175° F.;

a deflector coupled to said sprinkler body and positioned a preselected distance above said top region of said sprinkler body, said deflector comprises:

a generally planar member, said planar member having a perimeter;

a skirt depending from said perimeter of said planar member at a preselected angle from the vertical; and an annular ledge extending generally horizontally from said skirt, and said skirt being formed with a plurality of through-holes whereby said deflector is configured to generate a spray distribution pattern of fire extinguishing fluid over an area to be protected.

59. An early suppression fast response (ESFR) upright sprinkler head for dispensing fire extinguishing fluid in the event of a fire, comprising:

a sprinkler body configured for attachment to a fire extinguishing fluid supply line, said sprinkler body having an orifice in fluid communication with the fire extinguishing fluid supply line wherein the extinguishing fluid flows upwardly from said orifice when said sprinkler head is actuated in the event of a fire, said sprinkler body having a top region, said sprinkler body having a K value of at least approximately 13.5; and a deflector coupled to said sprinkler body, said deflector having an impact surface and including a plurality of through-holes wherein said deflector generates a spray distribution through said through-holes radially outward from said deflector whereby said defector is configured to generate a spray distribution pattern of fire extinguishing fluid over an area to be protected, said deflector having:

a generally planar member, said planar member having a perimeter, a skirt depending outwardly from said perimeter of said planar member at a preselected angle from the vertical, wherein said preselected angle is between approximately 12° and 26°, and an annular ledge extending generally horizontally from said skirt.

60. The upright sprinkler head as recited in claim 59, wherein said preselected angle is between approximately 15° and 23°.

61. The upright sprinkler head as recited in claim 59, wherein said preselected angle is between approximately 18° and 20°.

62. The upright sprinkler head as recited in claim 59, wherein said planar member has an inner surface formed with a plurality of ribs.

63. The upright sprinkler head as recited in claim 62, wherein said planar member has a central region, and wherein said plurality of ribs extend from said central region of said planar member in a radial pattern.

64. The upright sprinkler head as recited in claim 59, wherein said skirt is formed with said plurality of through-holes.

* * * * *

UNITED STATES PATENT AND TRADEMARK OFFICE

CERTIFICATE OF CORRECTION

PATENT NO. : 6,585,054 B1
APPLICATION NO. : 09/579552
DATED : July 1, 2003
INVENTOR(S) : Peter W. Thomas et al.

It is certified that error appears in the above-identified patent and that said Letters Patent is hereby corrected as shown below:

Column 1:
Line 57, Delete "." after "downwardly"

Column 4:
Line 20, "ieffectively" should be --effectively--

Column 11:
Line 13, Insert --10-- after "head"

Column 13:
Line 39, "10" should be --10'--
Line 68, "10" should be --10'--

Column 15:
Line 50, insert --5-11.5.3-- before "5-11.5.3.2"
Line 55, "sprinklerhead" should be --sprinkler head--

Column 16:
* Line 52, Claim 1, "An upright early suppression fast reponse (ESFR)" should be --An early suppression fast response (ESFR) upright--

Column 17:
Line 24, Claim 5, Delete "A" before "The"
* Line 26, Claim 5, "a first channel and," should be --a first channel, and--
* Line 39, Claim 6, "said skirt depending from" should be --said skirt depends from--
* Line 43, Claim 7, "said skirt depending from" should be --said skirt depends from--
* Line 47, Claim 8, "said skirt depending from" should be --said skirt depends from--

Column 18:
* Line 19, Claim 16, "trigger assembly further comprises" should be --trigger assembly comprises--

Column 19:
* Line 9, Claim 24, "a first channel and," should be --a first channel, and--
* Line 58, Claim 33, Insert --first-- after "one".
* Line 65, Claim 34, "second" should be --first--.

Column 20:
* Line 25, Claim 38, "include" should be --in--.
* Lines 26-27, Claim 38, "at least one upright sprinkler" should be --upright sprinkler head--

UNITED STATES PATENT AND TRADEMARK OFFICE

CERTIFICATE OF CORRECTION

PATENT NO. : 6,585,054 B1
APPLICATION NO. : 09/579552
DATED : July 1, 2003
INVENTOR(S) : Peter W. Thomas et al.

It is certified that error appears in the above-identified patent and that said Letters Patent is hereby corrected as shown below:

Column 20 (cont'd)

* Line 27, Claim 38, "later" should be --lateral --.
* Line 35, Claim 39, "said upright sprinkler" should be --said upright sprinkler head--.
* Line 37, Claim 40, "said upright sprinkler" should be --said upright sprinkler head--.
* Line 44, Claim 42, "said upright sprinkler" should be --said upright sprinkler head--.
* Lines 48-58, Claim 42, "a sprinkler body having an orifice and a top region; a pair of legs extending from said top region of said sprinkler body; and a deflector attached to said pair of legs, said deflector having: a generally planar member, said planar member having a perimeter, a skirt depending from said perimeter of said planar member at a preselected angle from the vertical, and an annular ledge extending generally horizontally from said skirt." should be --a pair of legs extending from said top region of said sprinkler body; and said deflector attached to said pair of legs.--.

Column 21:

* Line 33, Claim 51, Delete "," after "than"

Signed and Sealed this

Seventeenth Day of April, 2007

JON W. DUDAS
*Director of the United States Patent and Trademark Office*